US009366025B2

(12) United States Patent
Ho

(10) Patent No.: US 9,366,025 B2
(45) Date of Patent: Jun. 14, 2016

(54) NOISE BARRIER AND A METHOD OF CONSTRUCTION THEREOF

(71) Applicant: Acoustics Innovation Ltd., Hong Kong (CN)

(72) Inventor: Wai Lun Ho, Hong Kong (CN)

(73) Assignee: Acoustics Innovation Ltd., Hong Kong (CN)

( * ) Notice: Subject to any disclaimer, the term of this patent is extended or adjusted under 35 U.S.C. 154(b) by 0 days.

(21) Appl. No.: 14/432,413

(22) PCT Filed: Apr. 11, 2014

(86) PCT No.: PCT/CN2014/075173

§ 371 (c)(1),
(2) Date: Mar. 30, 2015

(87) PCT Pub. No.: WO2014/166422

PCT Pub. Date: Oct. 16, 2014

(65) Prior Publication Data

US 2015/0267403 A1 Sep. 24, 2015

Related U.S. Application Data

(60) Provisional application No. 61/931,693, filed on Jan. 27, 2014, provisional application No. 61/811,137, filed on Apr. 12, 2013.

(51) Int. Cl.

| | |
|---|---|
| ***B64F 1/26*** | (2006.01) |
| ***E04B 1/99*** | (2006.01) |
| ***E01F 8/00*** | (2006.01) |

(52) U.S. Cl.
CPC ..... *E04B 1/994* (2013.01); *E01F 8/0011* (2013.01); *E01F 8/0088* (2013.01); *Y10T 29/49826* (2015.01)

(58) Field of Classification Search
CPC ..... E04B 1/86; B64F 1/26
USPC ..... 181/210, 287
See application file for complete search history.

(56) References Cited

U.S. PATENT DOCUMENTS

| | | | | |
|---|---|---|---|---|
| 3,307,809 | A * | 3/1967 | Lynn | 244/114 R |
| 3,473,786 | A * | 10/1969 | Luebke | 256/12.5 |
| 4,671,495 | A * | 6/1987 | Garland et al. | 256/12.5 |
| 6,085,861 | A * | 7/2000 | Jines | 181/30 |
| 7,793,886 | B2 * | 9/2010 | Henson, III | 244/114 B |
| 7,857,291 | B2 * | 12/2010 | Dombroski | 256/24 |

(Continued)

FOREIGN PATENT DOCUMENTS

| | | |
|---|---|---|
| CN | 2886006 Y | 4/2007 |
| CN | 2895514 Y | 5/2007 |

(Continued)

*Primary Examiner* — Forrest M Phillips
(74) *Attorney, Agent, or Firm* — Ware, Fressola, Maguire & Barber LLP

(57) ABSTRACT

A noise barrier is described having noise barrier panels capable of being moved by the force of wind from a dosed to an open position to allow passage of wind, so that the noise barrier has limited wind load. The noise barrier can be light weight because wind load on the noise barrier is limited. This provides that the noise barrier is easy to erect, possibly without requiring heavy machinery. The noise barrier panel is mounted on a mounting pole to be slide-able on the mounting pole, so that the noise barrier panel can be pushed from ground up.

20 Claims, 22 Drawing Sheets

(56) References Cited

U.S. PATENT DOCUMENTS

| | | | | |
|---|---|---|---|---|
| 7,921,960 | B2 * | 4/2011 | Jacobson et al. | 181/198 |
| 8,776,945 | B2 * | 7/2014 | Zimmerman | 181/210 |
| 2006/0257600 | A1 * | 11/2006 | Pilaar | 428/35.2 |

FOREIGN PATENT DOCUMENTS

| | | | | |
|---|---|---|---|---|
| DE | 2614568 | * | 4/1976 | E01F 7/00 |
| DE | 2614568 | A1 | 10/1977 | |
| GB | 2241000 | A | 8/1991 | |

* cited by examiner

NOISE BARRIER AND A METHOD OF CONSTRUCTION THEREOF

CROSS REFERENCE TO RELATED APPLICATIONS

This application is a National Stage of PCT International application no. PCT/CN2014/075173, filed 11 Apr. 2014, claiming priority in U.S. Provisional patent application No. 61/811,137 filed 12 Apr. 2013 and no. 61/931,693 filed 27 Jan. 2014, the contents of these documents being incorporated herein by reference.

FIELD OF INVENTION

This invention is related to noise barriers, and more particularly temporary noise barrier structures.

BACKGROUND OF INVENTION

Outdoor noise barriers have been erected next to construction sites for reducing construction noise from reaching nearby residential premises. Virtually all noise barriers have a large surface area for blocking or absorbing sound. In the outdoors, the wind load on such noise barrier structures can be very high occasionally, such as when there is a strong gust of wind. To prevent the noise barriers from being blown down, outdoor noise barriers are necessarily strong and heavy structures, constructed to withstand a wind load of 1 to 1.4 kPa in general. A strong concrete foundation is usually required for tall noise barriers of 6 m to 10 m. The erection and mobilization of such heavy noise barriers are energy and labour intensive, and have to be done using cranes and elevated platforms. Dismantling these heavy structures is also energy and labour intensive. Therefore, when a noise barrier is erected, it is typically intended to be a strong structure to remain standing next to the construction site for a significant period of time.

There is a growing demand for construction noise control in urban areas due to increasing public awareness on noise nuisance. However, if the source of noise lasts for only a short period of time or moves every few hours or days, which is typical of construction work on underground utilities beneath road surface, it would not be practical to erect and move such noise barriers along with the source of noise. Moreover, there may be difficulty in obtaining permission to lay a concrete foundation in some places. Construction of a concrete foundation may also not be allowed at day time due to road congestion, and may be allowable only at night time within a few limited hours. Therefore, it is desirable to provide a noise barrier which is relatively easy to erect, mobilize and dismantle, and which may be used as a temporal structure for a short period of time and which may be able to avoid damaging the existing ground to erect the noise barrier.

SUMMARY OF INVENTION

In a first aspect, the invention proposes a noise barrier comprising at least one noise barrier panel which is capable of being moved by the force of wind to allow passage of wind.

The invention provides the possibility of reducing wind load on the barrier structure during occasional strong gust, where such strong gust only occurs of once in a few months.

Therefore, the large surface area for blocking noise is capable of being reduced to allow wind to pass through the noise barrier. This effectively limits the wind load to be lower than that of a conventional noise barrier of the same surface area. As a result, the noise barrier does not have to be made of heavy material. The noise barrier can be made of light material. Constructing and dismantling a lightweight noise barrier can be easy, quick and suitable for temporary deployment. Use of cranes, elevated platforms, and concrete foundation is relieved. Noise barrier erection and mobilization can be even done quietly at night.

Typically, the at least one noise barrier panel has a close position for providing barrier to noise, the at least one noise barrier panel has an open position to allow passage of wind, wherein the at least one noise barrier panel is capable of being moved by the force of wind from the closed position to the open position.

Optionally, the at least one noise barrier panel is capable of folding to move from the closed position to the open position. Alternatively, the at least one noise barrier panel is capable of swiveling to move from the closed position to the open position. Any other type of panel configured to make way for wind to pass may be use.

Preferably, the at least one noise barrier panel comprises magnetic material for keeping the at least one noise barrier panel in the closed position. Using magnets improve the precision of positioning the noise barrier panel in the closed position.

More specifically, the at least one noise barrier panel has a first side having a first magnetic material; the at least one noise barrier panel has a second side having a second magnetic material; the second magnetic material of the second side of the at least one noise barrier panel being capable of magnetically cooperating with the first magnetic material of the first side of an adjacent noise barrier panel.

Preferably, the at least one noise barrier panel comprises an inflatable cushion. More preferably, the inflatable cushion contains plurality of inflatable segments. Segmenting the cushion prevents a bulge forming at the centre of the cushion. The gas pressure inside a plurality of inflatable segments provides an upright rigidity to the cushion, allowing the cushion to be held at one side while remaining upright to serve as a noise insulation panel.

Optionally, the inflatable cushion contains a liquid capable of absorbing sound energy. This can improve the sound energy absorption capability of the noise barrier panel.

In a second aspect, the invention proposes a noise barrier comprising at least one mounting pole, at least one noise barrier panel mounted on the at least one mounting pole to be slide-able along the mounting pole. This provides an advantage that a first noise barrier panel can be inserted at the bottom of a mounting pole, and then pushed up by a second noise barrier panel following the first noise barrier panel. An entire pole can be installed with a column of noise barrier panels manually, by a human operator pushing them upwardly from the ground. Even if a machine is required for a heavier embodiment, only a jack is needed to push the noise barrier panel from ground up. This relieves the need of any cranes or heavy machinery for installing noise barrier panels on scaffolding to provide a noise barrier.

In a third aspect, the invention proposes a noise barrier kit, comprising at least one mounting pole, at least one noise barrier panel suitable for mounting on the at least one mounting pole to be slide-able on the mounting pole. Therefore, the user is able to construct his own noise barrier at a time which is convenient to him.

In a forth aspect, the noise barrier panel comprises an inflatable body suitable for mounting onto a mounting pole. Accordingly, the inflatable body can be supplied by any third party manufacturer as long as the dimensions comply with requirements for the mounting.

Preferably, the at least one noise barrier panel comprises a first side having a first magnetic material, a second side having a second magnetic material, the second magnetic material of the second side of the at least one noise barrier panel being capable of magnetically cooperating with the first magnetic material of the first side of an adjacent noise barrier panel.

In a fifth aspect, the invention proposes a method of installing a noise barrier comprising the steps of: providing at least one mounting pole, providing a first noise barrier panel, mounting the first noise barrier panel onto the at least one mounting pole, sliding the first noise barrier panel along the at least one mounting pole. This allows the noise barrier to be constructed simply by pushing the noise barrier panel up from the ground, and relieves the need for cranes to lift noise panels into the air for mid-air installation. Accordingly, the noise barrier can now be constructed with less reliance on heavy machinery.

BRIEF DESCRIPTION OF DRAWINGS

It will be convenient to further describe the present invention with respect to the accompanying drawings that illustrate possible arrangements of the invention, in which like integers refer to like parts. Other embodiments of the invention are possible, and consequently the particularity of the accompanying drawings is not to be understood as superseding the generality of the preceding description of the invention.

DETAILED DESCRIPTION OF THE INVENTION

Figure 1:
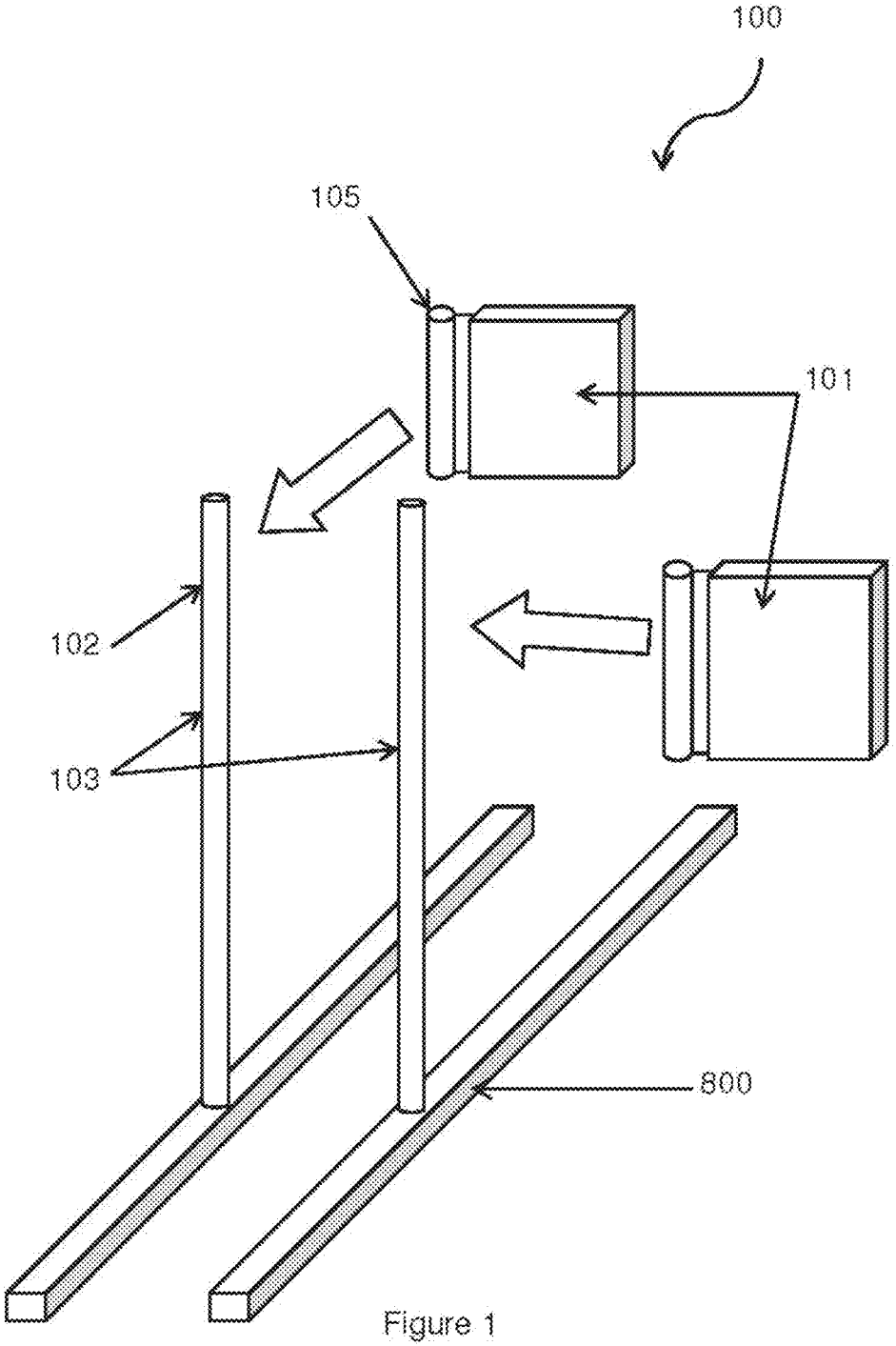
FIG. 1 is an exploded view of a first embodiment of the invention.

FIG. 1 is a schematic of an exploded view of a first embodiment, which is a noise barrier 100 having noise barrier panels 101 that can be blown open by wind. This limits the wind load on the noise barrier 100, mounting poles 102 and frame 103, as any instance of undesirably high wind bad is reduced immediately when noise barrier panels 101 are blown open to reduce the noise barrier surface area facing the wind.

The term 'wind load' refers to the pressure or force induced on a structure by wind, and is one of the most critical parameters in outdoor noise barrier design. Wind load is approximately directly proportional to the cross-sectional area of a surface orthogonal to wind direction and square of the wind speed:

$$F=1/2\rho V2A\mathrm{Cd} \quad (1)$$

Where:

ρ=Density of air V=Wind speed

A=Cross sectional area orthogonal to wind speed

Cd=Coefficient of drag F=Force of wind load

In some embodiments, the reduction of orthogonal surface area possibly reduces the wind load to one tenth or lower than that of an un-openable noise barrier. It should be noted that Cd is also reduced at the barrier opened position.

Having a low wind load design allows the noise barrier 100 to be made of light weight material. As a result, the noise barrier can be constructed without need of heavy machinery and concrete foundation, and can be erected quickly even as a temporary structure that can be dismantled easily. Accordingly, the noise barrier 100 is capable of quick and temporary deployment near residential estates where installing conventional noise barrier with strong structure is not feasible or cost-effective.

The embodiment comprises two basic parts, namely mounting poles 102 and noise barrier panels 101. Two mounting poles 102 together form a frame 103 across which a noise barrier panel 101 may be placed to absorb or block noise.

The noise barrier panel 101 is a lightweight planar block having a surface for sound blocking and/or absorption. The block arrows show schematically that each noise barrier panel 101 can be mounted onto a mounting pole 102. Each noise barrier panel 101 has a sleeve 105 at one of its lateral sides, for slipping over and being moved along the mounting pole 102. The sleeve 105 is preferably made of a strong fabric or plastic, such as those used for parachutes or for military tents.

The mounting poles 102 are preferably made of a strong and light material such as carbon fiber or aluminium.

Figure 2:
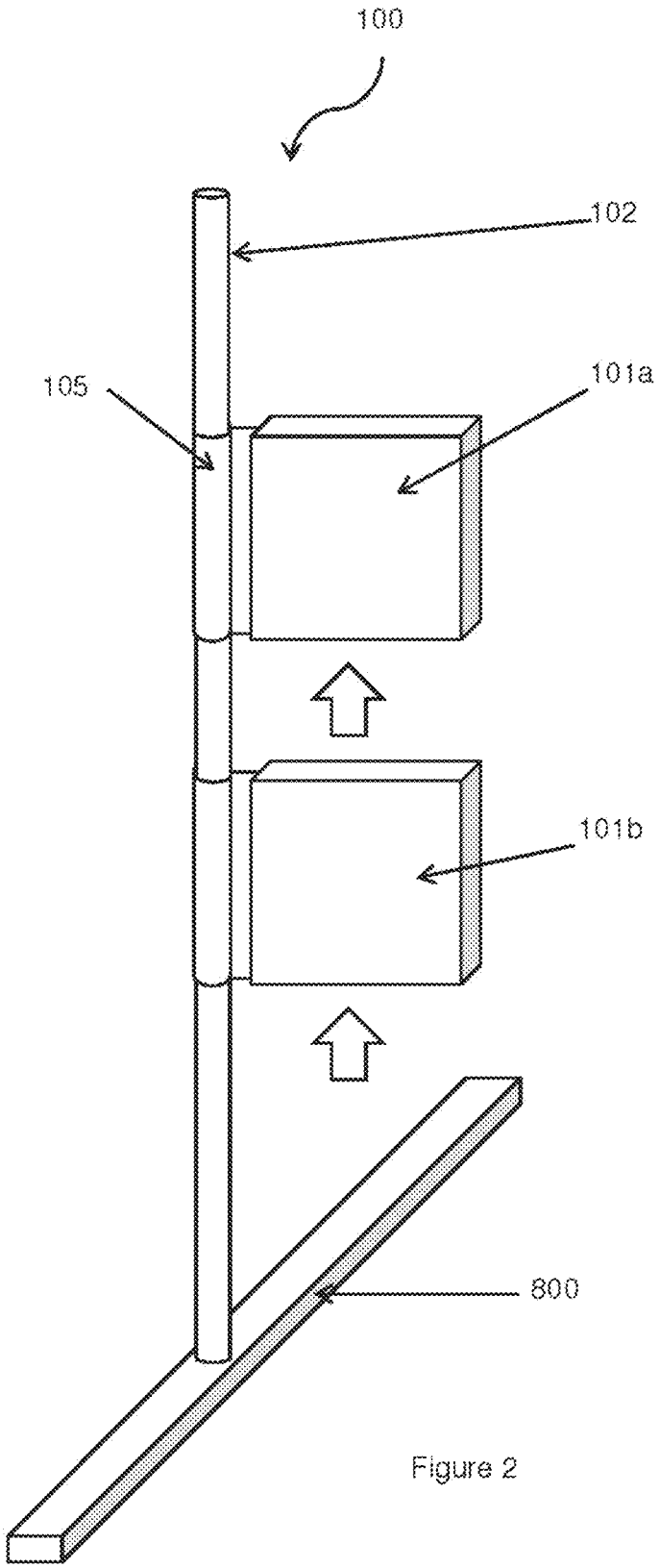
FIG. 2 shows the constructed embodiment of FIG. 1.

FIG. 2 shows the sleeve 105 of a noise barrier panel 101*a* enveloping the lower part of a mounting pole 102, at a height where a man can reach easily, and is pushed up on the mounting pole 102. A further noise barrier panel 101*b* can be attached to the mounting pole 102 in the same way below the first noise barrier panel 101. The block arrows show how pushing the lower noise barrier panel 101*b* upwards pushes the first noise barrier panel 101*a* higher on the pole. Eventually, a sufficient number of noise barrier panels 101 are attached to a mounting pole 102 forming an assembled column of noise barrier panels 101 and providing a combined large surface area suitable for use as effective noise barrier 100.

Figure 3:
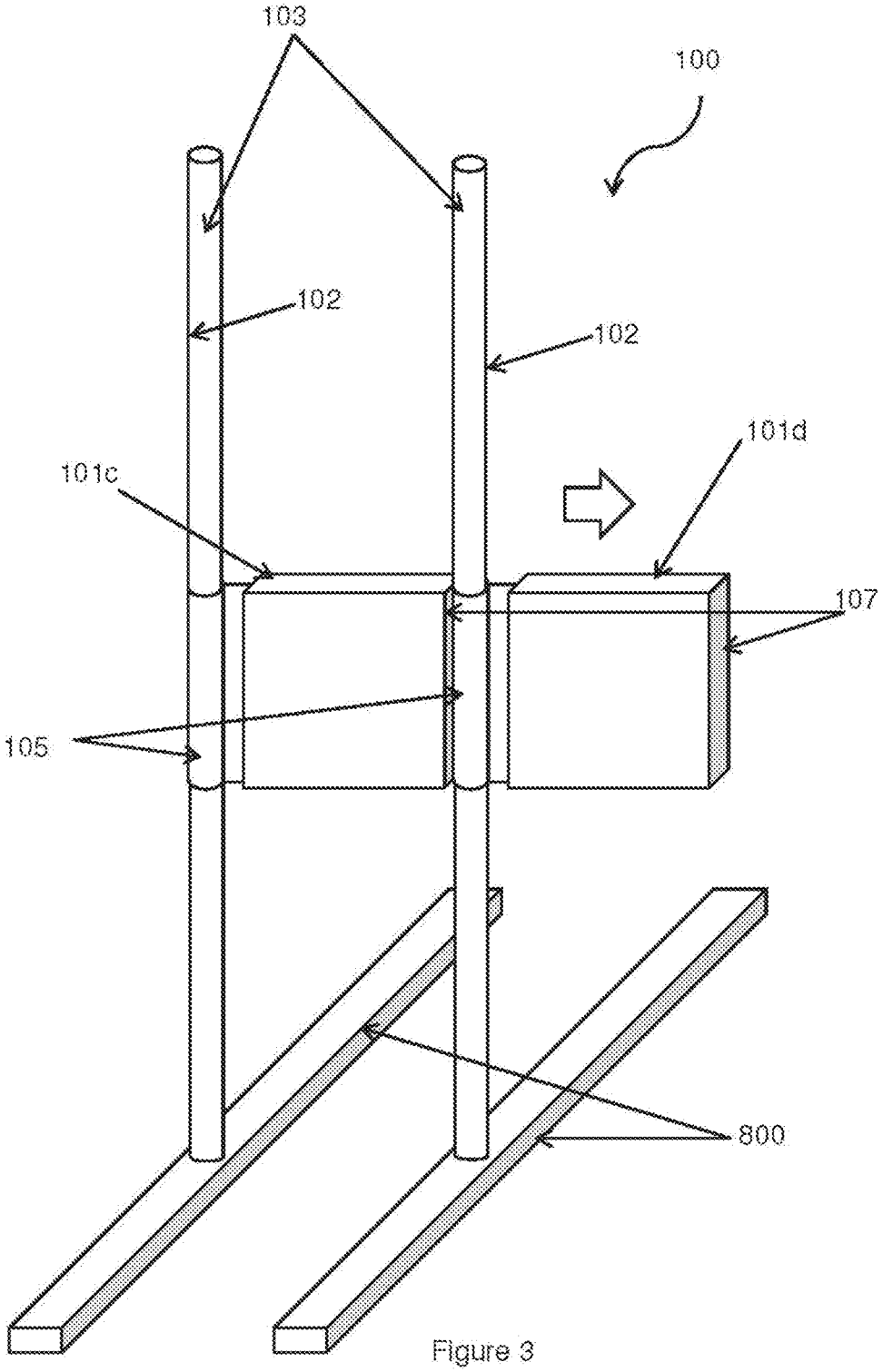
FIG. 3 also shows the constructed embodiment of FIG. 1.

FIG. 3 shows how a noise barrier panel 101*c* cooperates with an adjacent noise barrier panel 101*d* side-wise to extend the noise barrier 100 laterally. The sleeve 105 of each noise barrier panel 101 is installed with a magnetic material. The free-swinging vertical side 107 of the noise barrier panel 101, which is distal from the sleeve 105, is also installed with a magnetic material. Therefore, two laterally adjacent noise barrier panels 101*c*, 101*d* cooperate by the vertical side 107 of a first noise barrier panel 101*c* being in magnetic cooperation with the sleeve 105 of the adjacent noise barrier panel 101*d*. The magnetic cooperation keeps the noise barrier panels 101 stationary in a closed position under normal conditions, which forms a continual wall for blocking sound. In the occasional strong gust of wind, the wind load may be high enough to break the magnetic cooperation so that each noise barrier panel 101 may swivel into an open position relative to the mounting pole 102 inserted through the panel sleeve 105. This reduces the wind load immediately. In other words, the swiveling noise barrier panel 101 limits the wind load on the noise barrier 100.

Figure 4:
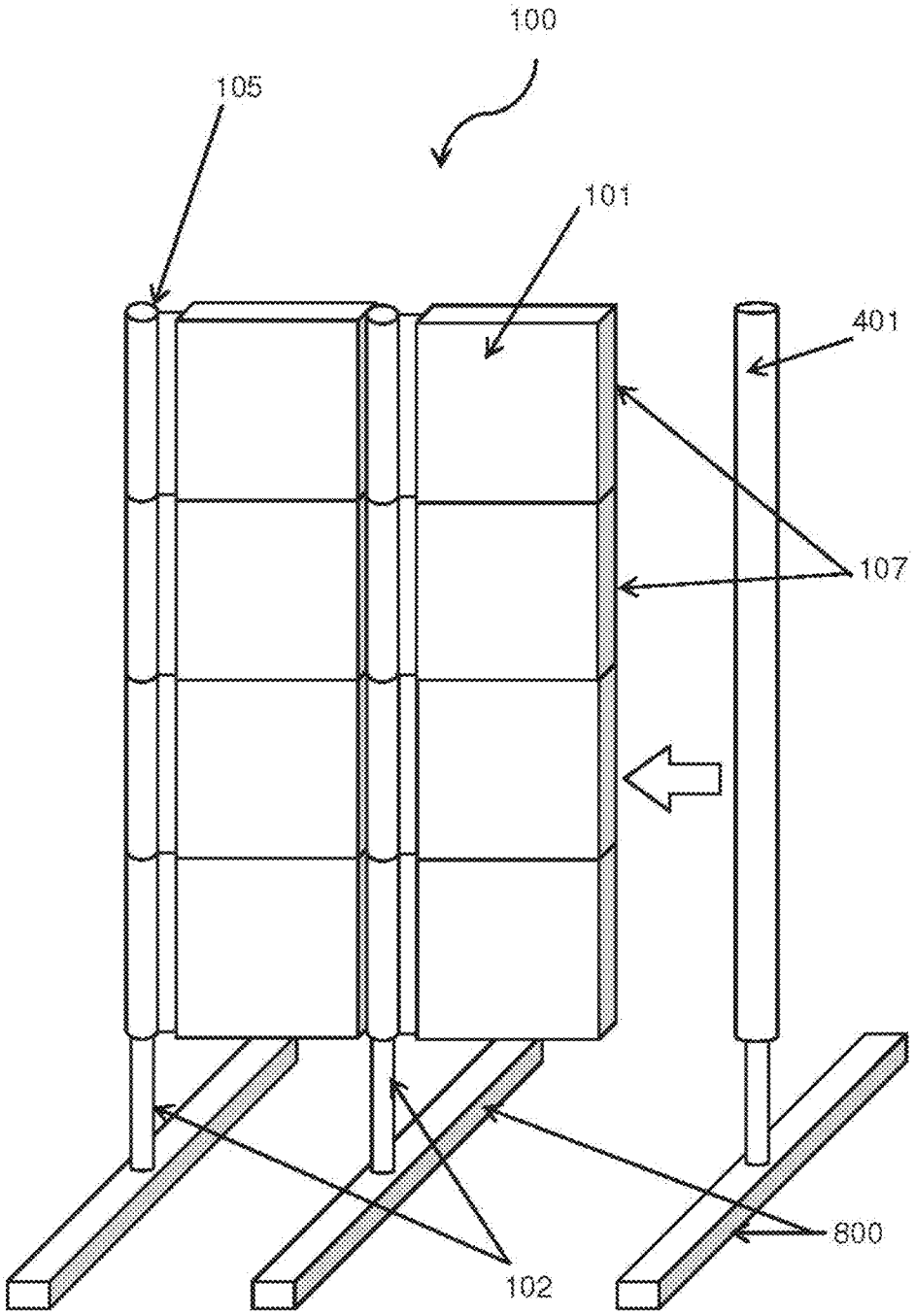
FIG. 4 shows the constructed embodiment of FIG. 1 more completely.

FIG. 4 shows how an end-pole 401 provides magnetic cooperation to keep the end-most column of noise barrier panels 101 in the closed position. The length of the end-pole 401 is installed with magnetic material. The free-swinging vertical sides 107 of the end column of noise barrier panels 101 are placed in magnetic cooperation with the end-pole 401, instead of the sleeves 105 of a further column of noise barrier panels 101.

Figure 5:
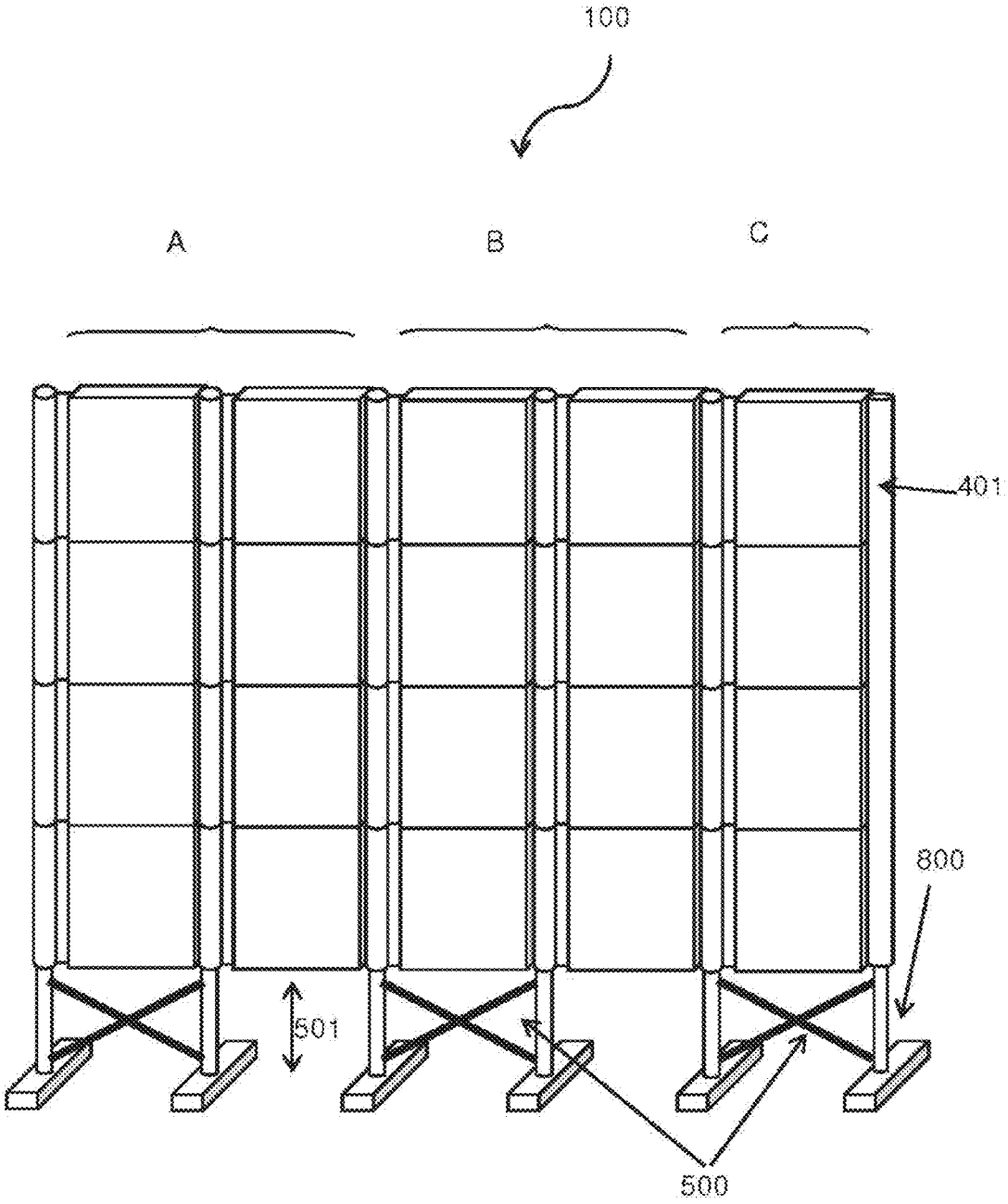
FIG. 5 also shows the constructed embodiment of FIG. 1.

FIG. 5 shows an assembled wall of five columns of noise barrier panels 101 ended by an end-pole 401. Every two mounting poles 102 forming a frame 103 can be integrated using an X-shape cross-bar 500 at the bottom of the frame 103. Thus, every frame 103 forms the smallest unit of noise barrier 100 that can stand stably on two ground supports, whether the frame 103 has one or two columns of noise barrier panels 101. This smallest stable unit can be moved manually and easily. There are two tow-column units, A & B, and an end-column unit C in FIG. 5. The end-pole 401 is not sleeved with any noise barrier panels 101 and only provides magnetic cooperation with the free-swinging vertical sides 107 of the last column of noise barrier panels 101.

Figure 6:
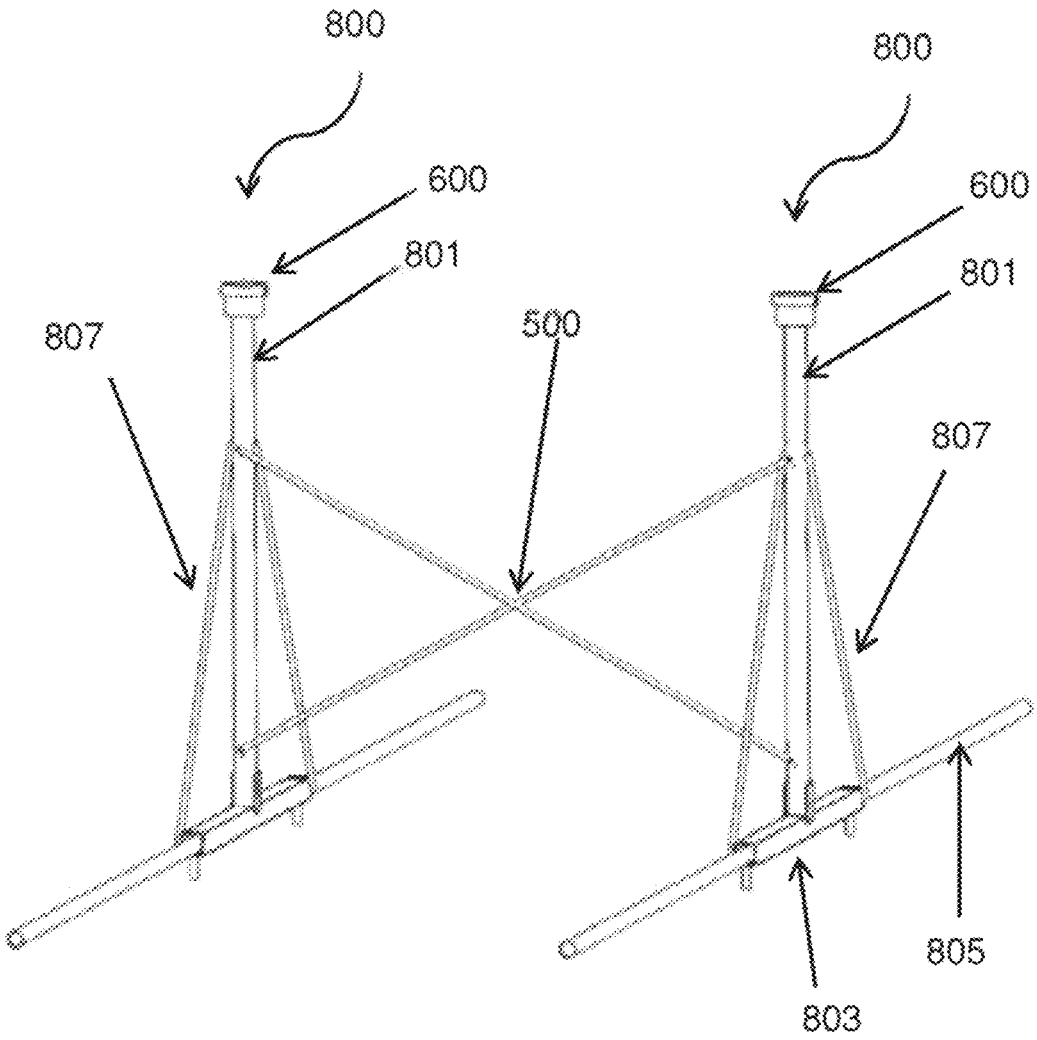
FIG. 6 is a detailed illustration of a part of the embodiment of FIG. 1.

Each mounting pole 102 is installed on a base 800. The base 800 can be seen in greater detail in FIG. 6 showing a pair of bases joined by a cross bar 500. The base 800 is an inverted T-shape metal mounting, made up of a square tube 803 and a pole holder 801 extending upwardly from the square tube 803. A mounting pole 102 is inserted into the pole holder 801. Optionally, the square tube 803 can be bolted to the ground for stability. Alternatively, each square tube 803 is inserted with a long ground pole 805 for more stability. Sandbags can also be placed on the square tube 803 for additional stability. Each base 800 has slanted tubes 807 between the square tube 803 and the pole holder 801 to provide rigidity for the T-shape base 800.

Figure 7:
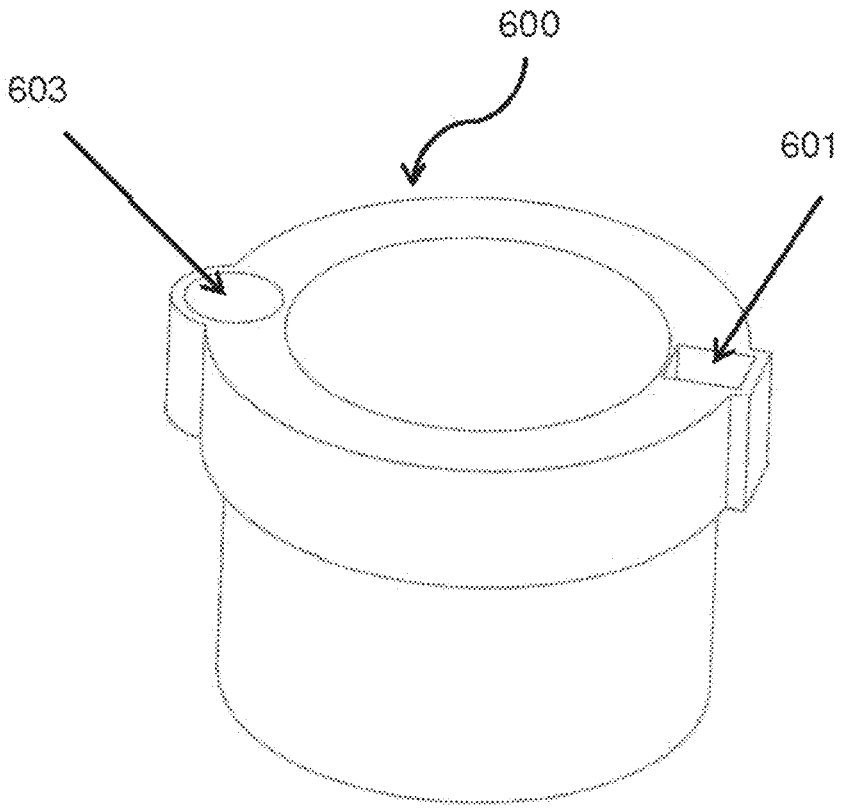
FIG. 7 shows a securing device used in the embodiment of FIG. 1.

The lowest noise barrier panel 101 on each mounting pole 102 is supported by a sleeve-ring. An illustration of the sleeve-ring 600 is shown in FIG. 7. The inner diameter of the sleeve-ring 600 allows the sleeve-ring 600 to be inserted over a mounting pole 102. However, the inner diameter of the sleeve-ring 600 is too small to slip over a pole holder 801 of a base 800. Therefore, the sleeve-ring 600 sits on the top of the pole holder 801 and supports an entire column of noise barrier panels 101 in turn sitting on the sleeve-ring 600.

Optionally, if higher noise insulation performance is required, the gap 501 between the lowest noise barrier panels 101 of the noise barrier 100 and the ground is closed by flexible noise barrier mats or individual solid panels. The gap 501 is indicated in FIG. 5.

Figure 8:
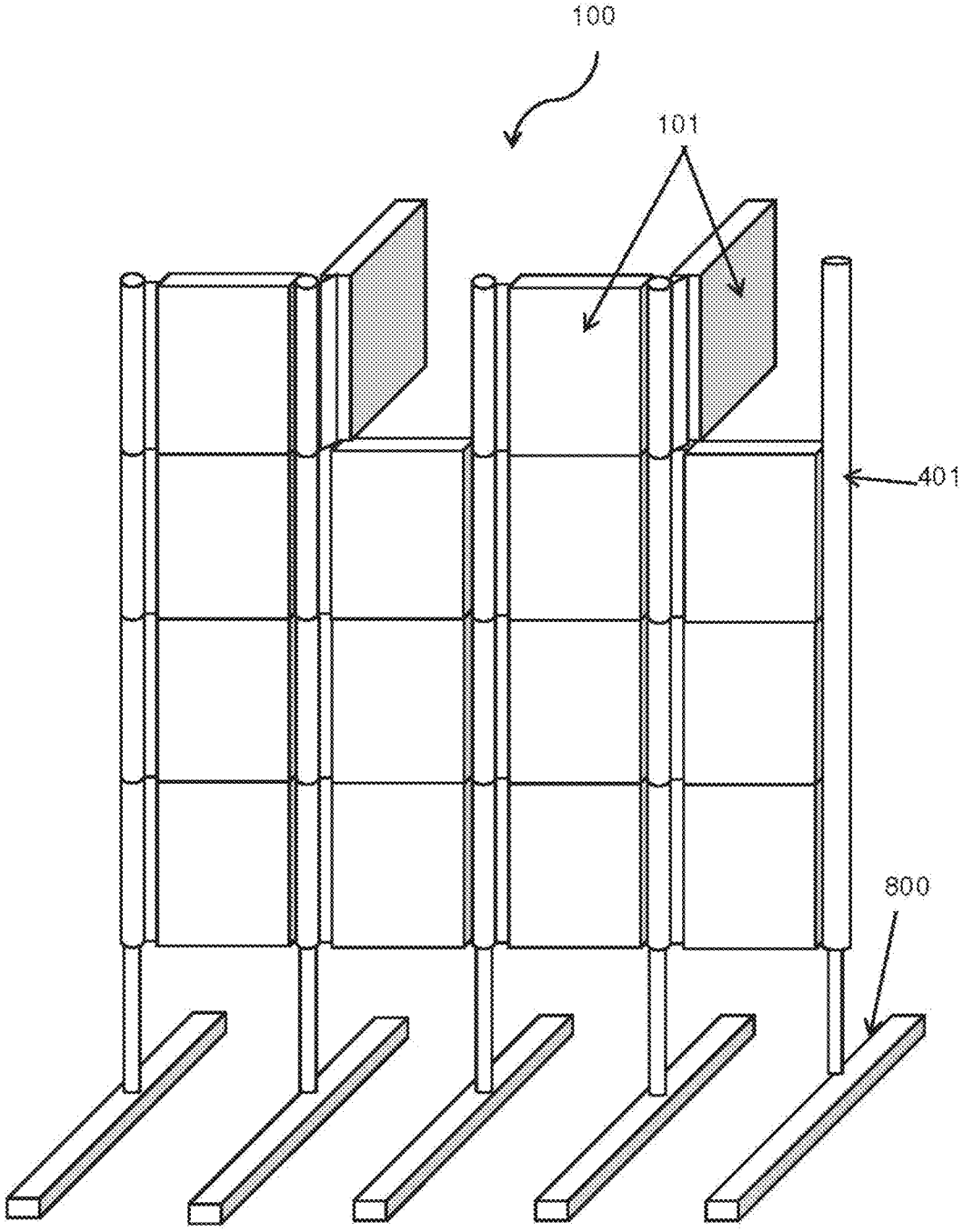
FIG. 8 shows the embodiment of FIG. 1 in partial opened position.

FIG. 8 shows two top noise barrier panels 101 swiveled by wind into the open position. This provides a wind load reduction mechanism; the opened noise barrier panels 101 provide wind passage through the noise barrier 100 and reduce the surface area facing the wind. In the closed position, the noise barrier is situated such that the panels 101 face the construction site and provide maximum noise insulation. Although the noise barrier panels 101 are illustrated as being moved into the page, the noise barrier panels 101 can swivel in any direction about the mounting pole 102 according to the wind direction.

The minimum wind strength which can open a noise barrier panel 101 is a threshold determined by the strength of the magnetic and/or mechanical cooperation between two adjacent noise barrier panels 101. The threshold is preferably 0.02 to 0.3 kPa, which corresponding to wind speeds of approximately 20 to 75 kph directly heading on the noise barrier panel 101. This is approximately only 2% to 20% of the wind load required of conventional outdoor noise barriers. When wind speed is below this threshold, the noise barrier panels can remain closed. When wind speed is above this threshold, one or more of the noise barrier panels can be blown open, immediately reducing the wind load on the noise barrier 100 as an automatic mechanism. In this way, the threshold limits the wind load on the noise barrier 100.

Typically, the noise barrier panel 101 is small and lightweight. The surface of each noise barrier panel 101 for facing the construction site is typically less than 5 m2 to keep the noise barrier panel 101 small and manually manageable. The surface density of noise barrier panel 101 is preferably less than 3 kg/m2, in order to keep the noise barrier panel 101 lightweight. In some other cases, the preferred surface density is around 1 to 2 kg/m2.

Figure 9:
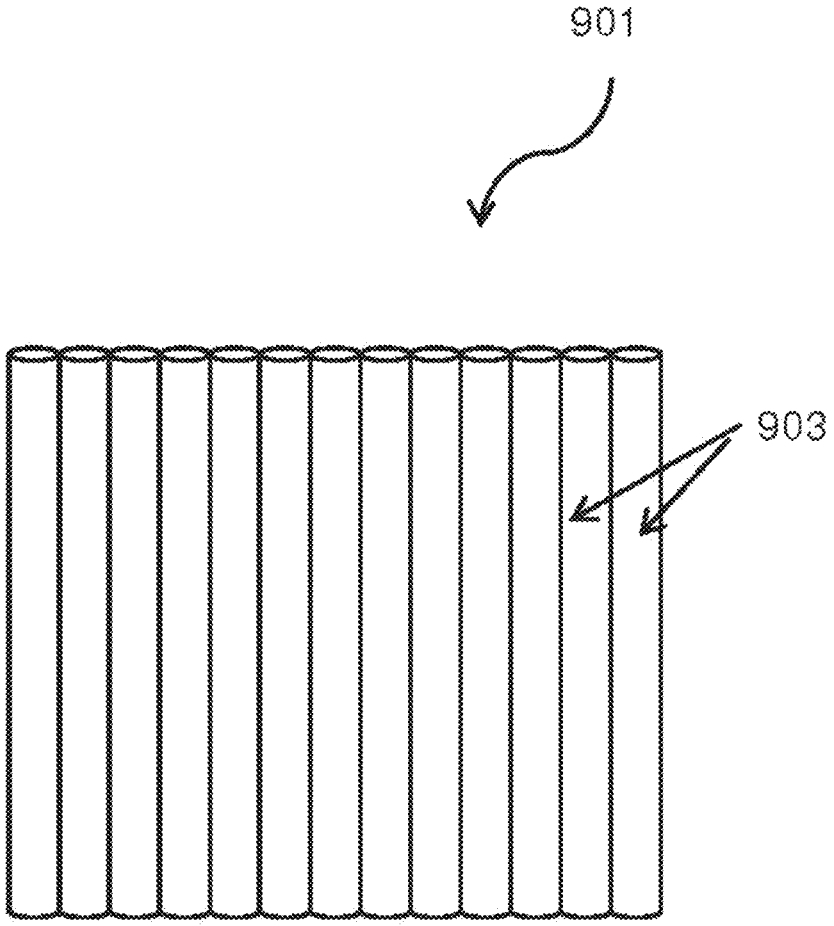
FIG. 9 illustrates an example of a noise barrier panel with inflatable segments used in the embodiment of FIG. 1.

FIG. 9 shows gas inflatable cushion 901, which is the preferred component used as the core of the noise barrier panel 101. More preferably, the gas inflatable cushion 901 comprises a plurality of gas inflated segments, or gas-inflated tubes 903 joined together. A segmented configuration prevents a bulge from forming at the centre of the inflated cushion, as is the case often seen in un-segmented cushions. The gas-inflated tubes are light, bulky and flexible. When stood vertically, the segmented gas-inflated tubes 903 being filled by gas provides vertical rigidity to the cushion. If the gas-inflated tubes 903 are bent across the middle of the segments, the gas pressure inside is capable of returning the gas-inflated tubes 903 to their original shape. The gas in the inflatable cushion 901 may also serve as a good sound absorber with specific internal arrangement. The resonance frequency of the gas inflated tubes 903 can be tuned by adjusting their gas pressure. The gas can be air, nitrogen or any other suitable and safe choice.

Figure 10:
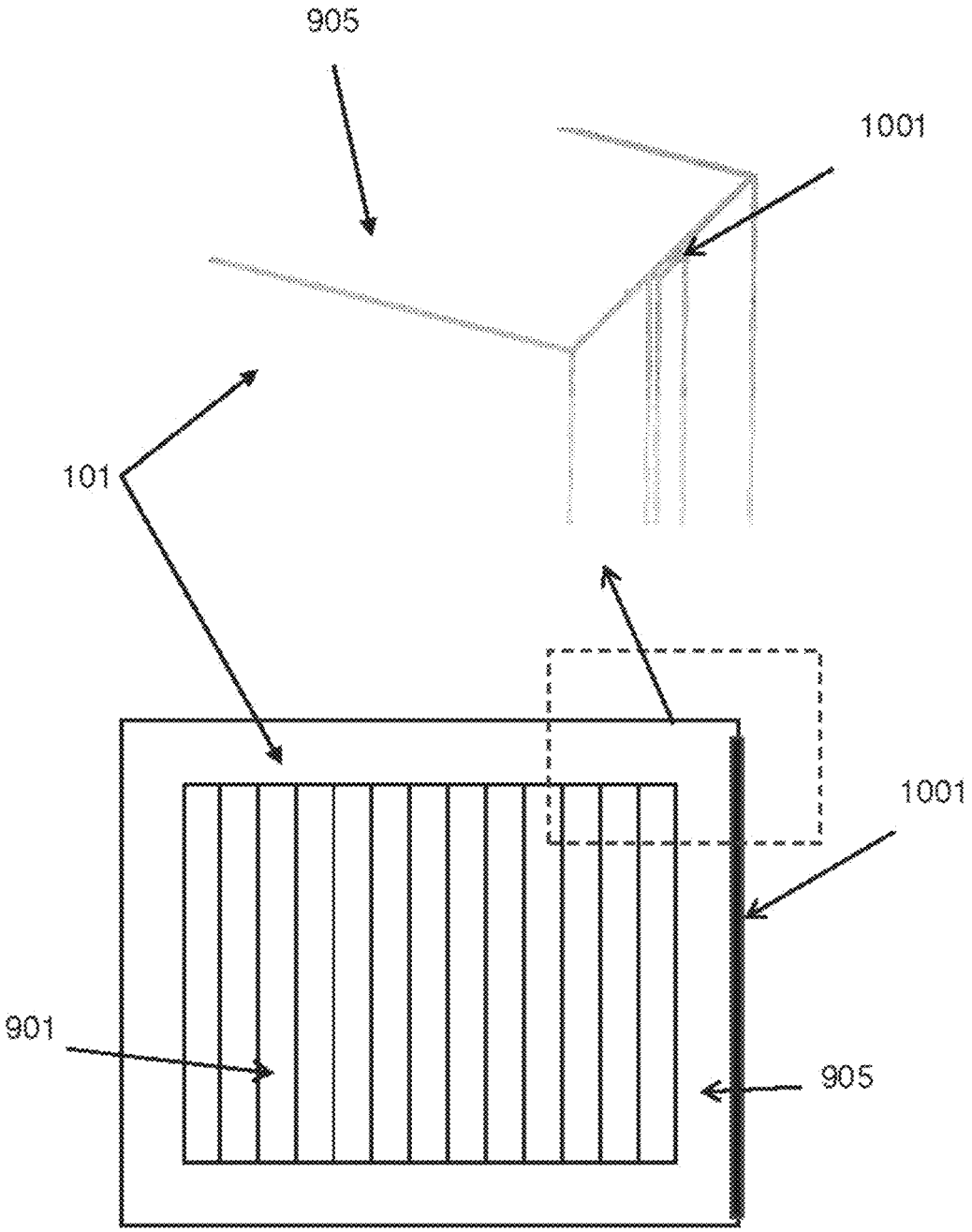
FIG. 10 illustrates the noise barrier panel of FIG. 9 in greater detail.

FIG. 10 shows the gas inflatable cushion 901 set in a styrofoam framing 905.

Figure 11:
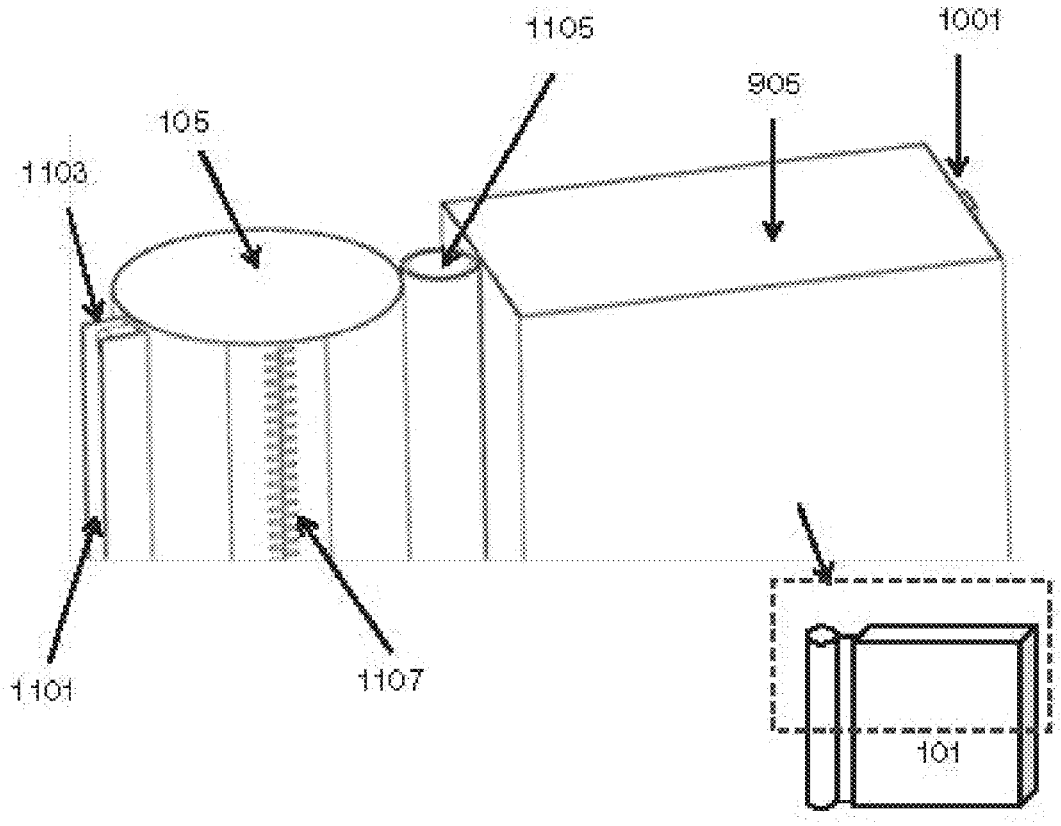
FIG. 11 illustrates the noise barrier panel of FIG. 10 in greater detail.

The framed gas inflatable cushion 901 is wrapped in fabric or plastic sheets, or preferably enveloped in a flexible fabric bag (not illustrated). FIG. 11 shows an enlarged view of a corner of the noise barrier panel 101 in greater detail. The fabric at one side of the noise barrier panel 101 is sewn into a sleeve 105 for enveloping a mounting pole 102. The sleeve 105 is open-able and close-able by a zipper 1107 that runs along the full length of the sleeve 105. This allows the sleeve 105 to be opened, placed around the mounting pole 102 and zipped up to envelope the mounting pole 102. At a side of the sleeve 105 is installed a U-shaped aluminium trough 1101. A magnetic material 1103 such as magnets is provided inside the U-shaped aluminium trough 1101.

The fabric material enveloping the noise barrier panel 101 provides additional sound insulation layers and allows the noise barrier panel 101 to swivel about the sleeve.

Preferably, between the sleeve 105 and the gas inflatable cushion 901 is a smaller sleeve 1105 into which is inserted an aluminium rod. The aluminium rod ensures a minimum distance between the gas inflatable cushion 901 and the sleeve 105 which gives room to swivel the gas inflatable cushion 901. The aluminium rod also provides structure for bearing up the aluminium rod of the panel 101 on top. Correspondingly, the sleeve-ring 600 of FIG. 7 has a tube holder 601 shaped for holding the U-shaped aluminium trough 1101 and a circular tube holder 603 for the aluminium tube, which respectively receives the U-shaped aluminium trough 1101 and the aluminium tube of the lowest noise barrier panel 101 on the mounting pole 102. Other material such as plastics, carbon fibre and so on may be used in place of aluminium in other embodiments.

The U-shaped aluminium trough 1101 is configured such that the ends of the U-shaped aluminium troughs 1101 of a column of noise barrier panels 101 can fit into each other (not illustrated). Similarly, the ends of the aluminium tubes in the columns of noise barrier panels 101 can fit one into another (also not illustrated).

Figure 12:
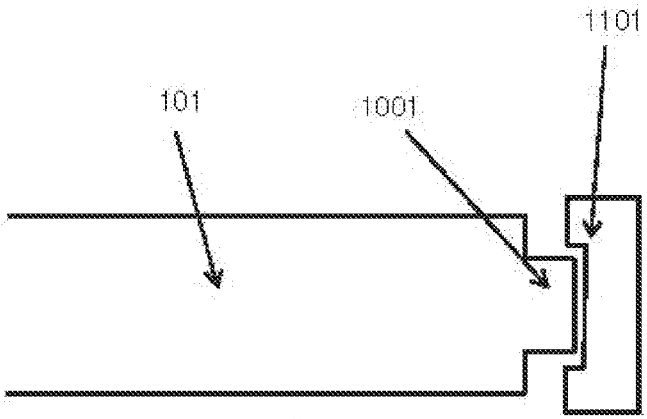
FIG. 12 illustrates a locking mechanism in the noise barrier panel of FIG. 10.

FIG. 12 is a schematic plan view of a panel 101 in a dosed position, showing how a galvanized steel plate 1001 attached to the free-swinging vertical side 107 of a noise barrier panel 101 is located into a U-shaped aluminium trough 1101 of an adjacent noise barrier panel 101. FIG. 10 also shows the free-swinging vertical side 107 of the noise barrier panel 101 installed with the galvanized steel plate 1001.

Figure 13:
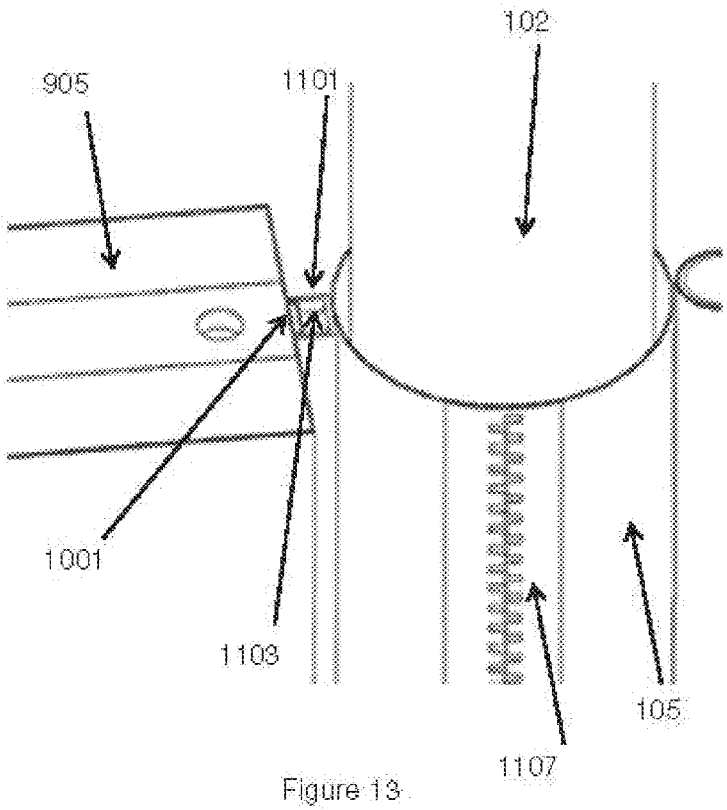
FIG. 13 illustrates the noise barrier panel of FIG. 10 in greater detail.

FIG. 13 shows in greater detail how the galvanized steel plate 1001 fits into U-shaped aluminium trough 1101 of the adjacent noise barrier panel 101. The sleeve 105 is illustrated in FIG. 13 with a mounting pole 102 extending through it. In the closed position of a noise barrier panel 101, the galvanized steel plate 1001 is dimensioned to fit loosely into the U-shaped aluminium trough 1101 of an adjacent noise barrier panel 101, which provides a simple recessed locking mechanism between the two panels. The galvanized steel plate 1001 also provides magnetic cooperation with magnets in the sleeve 105 with of the adjacent noise barrier panel 101, which improves the strength of the recessed locking mechanism. The wind load threshold of the noise barrier panel 101 can be determined by how much the galvanized steel plate 1001 extends into the U-shaped aluminium trough 1101 and by changing the number, size and type of magnets installed in the U-shaped aluminium trough 1101.

As the skilled man will know, variations of the locking mechanism are possible. For example, the magnets are attached to the free-swinging vertical side 107 of the noise barrier panel 101 and a ferromagnetic material such as galvanized steel is placed in the U-shaped aluminium trough 1101. Alternatively, magnets are attached both to in the U-shaped aluminium trough 1101 and at the free-swinging vertical side 107.

Typically, the strengths of the locking mechanisms and the magnetic cooperation between all the noise barrier panels 101 are the same. Every noise barrier panel 101 has the same wind load threshold.

In a variation of the embodiment, different noise barrier panels 101 are provided with different strengths of locking mechanism and magnetic cooperation with the sleeve 105 of the adjacent noise barrier panel 101; different noise barrier panels 101 are tuned to different wind load thresholds. The noise barrier panels 101 at the top of the mounting poles 102 can have the lowest threshold in order to limit the wind load at the upper end of the mounting poles 102, and the threshold of the noise barrier panels 101 lower on the mounting poles 102 is greater.

Figure 14:
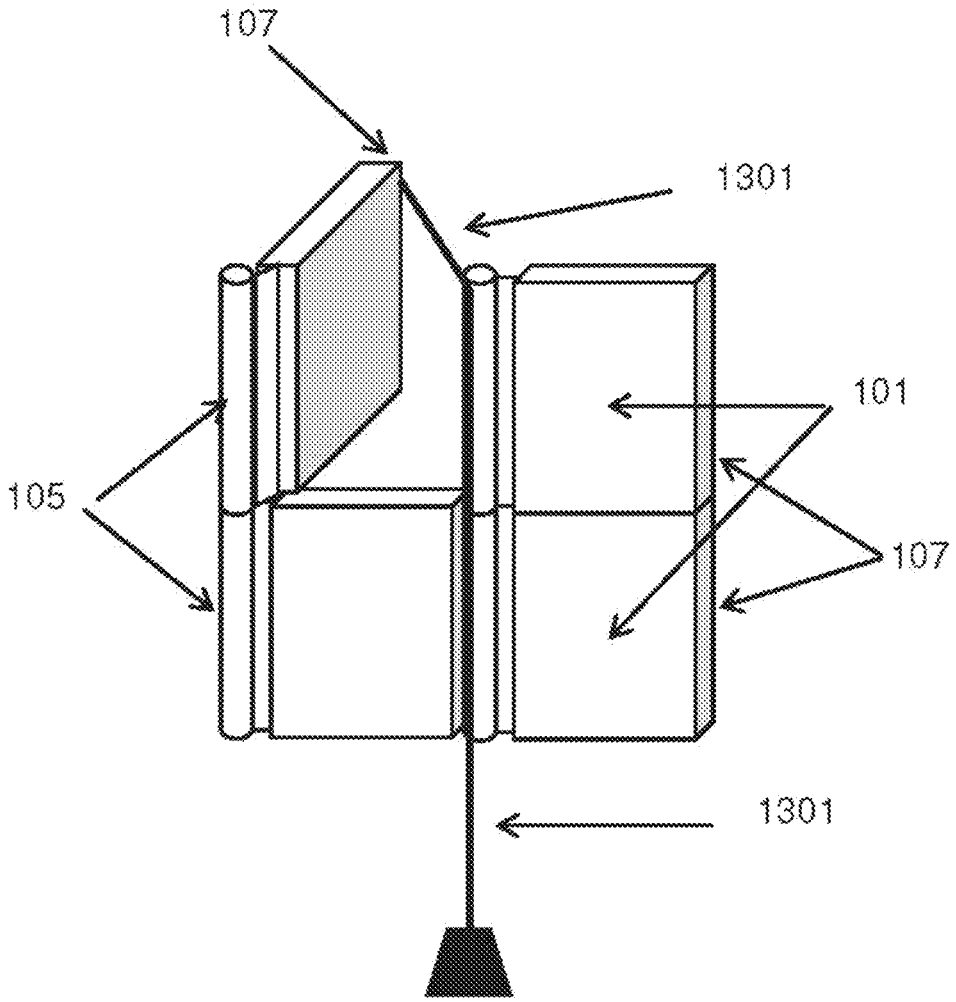
FIG. 14 illustrates a variation of the noise barrier panel of FIG. 10.

In the simplest mode, a noise barrier panel 101 in the open position can be closed using a rod to push the noise barrier panel 101 back towards the closed position, and the magnetic attraction between the free-swinging vertical side 107 of a noise barrier panel 101 and the sleeve 105 of the adjacent noise barrier panel 101 will attract the noise barrier panel 101 back into the closed position. Optionally, a resilient device such as a weak spring can be used to urge each noise barrier panel 101 into the closed position. The spring has to be weak enough not to interfere with the threshold level of wind load at which the noise barrier panel 101 should open. Alternatively, as shown schematically in FIG. 14, the free-swinging vertical side 107 of each noise barrier panel 101 can be tied to a string which is threaded to a pulley system 1301 loaded with a weight threading through the adjacent mounting pole 102.

Figure 15:
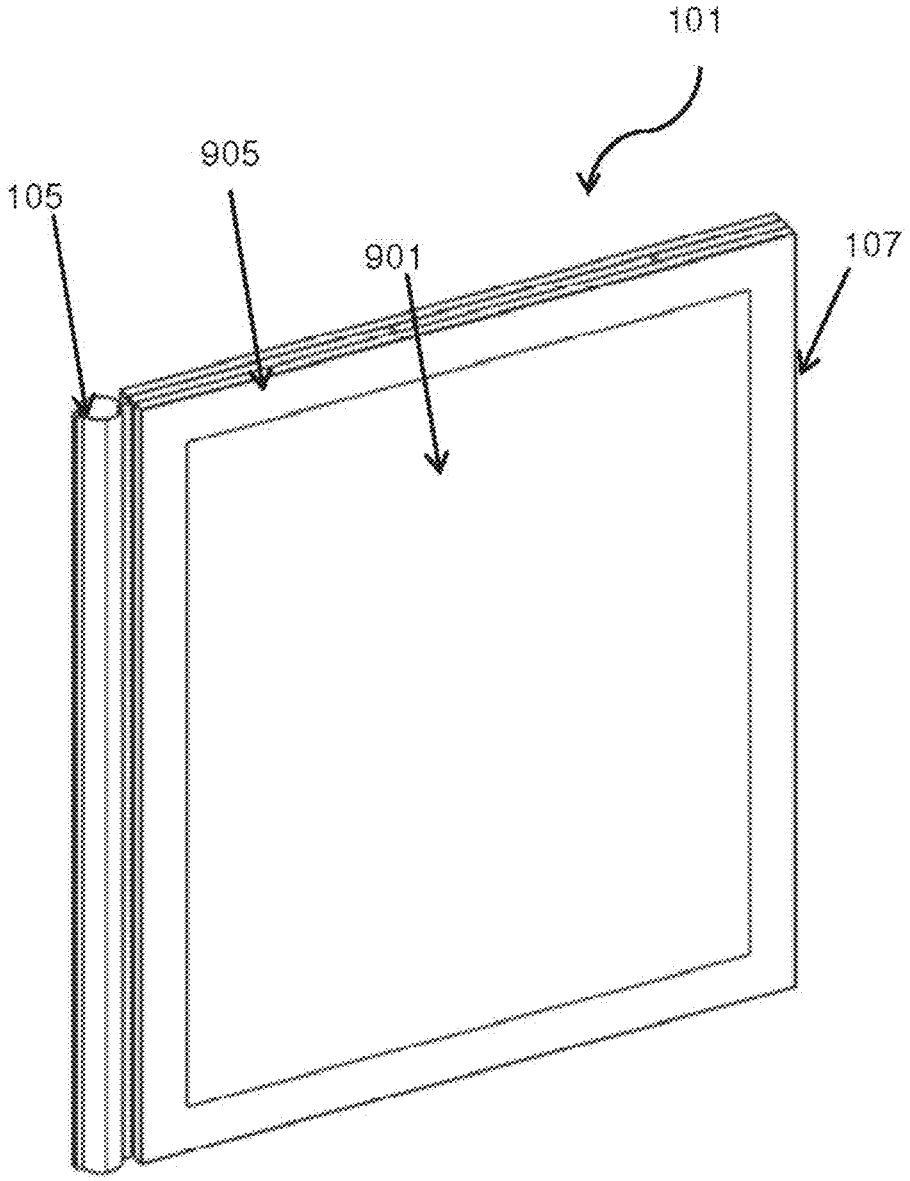
FIG. 15 illustrates the noise barrier panel of FIG. 10 in greater detail.

FIG. 15 is a zoomed out illustration of the noise barrier panel 101.

In a variation of the embodiment, the noise barrier panels 101 on the same mounting pole 102 can be locked together, so that the column of noise barrier panels 101 behaves like one large panel. Thus, to close the column of noise barrier panels 101, the operator need only push the lowest noise barrier panel 101 back into the dosed position.

Figure 16:
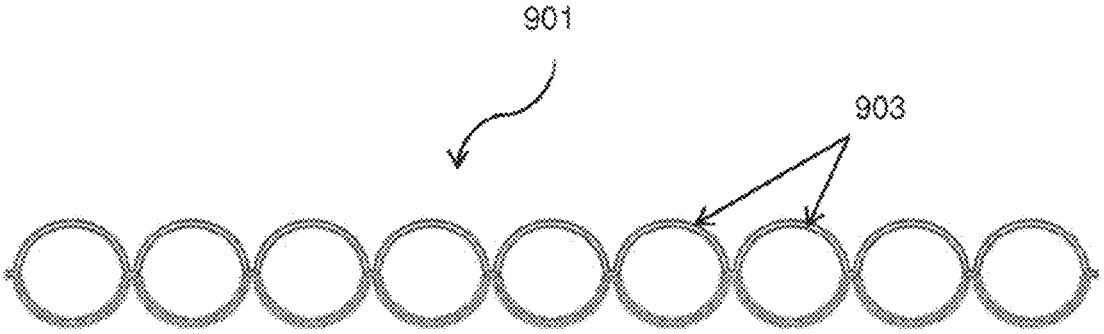
FIG. 16 illustrates a specific detail of the noise barrier panel of FIG. 10.
Figure 17:
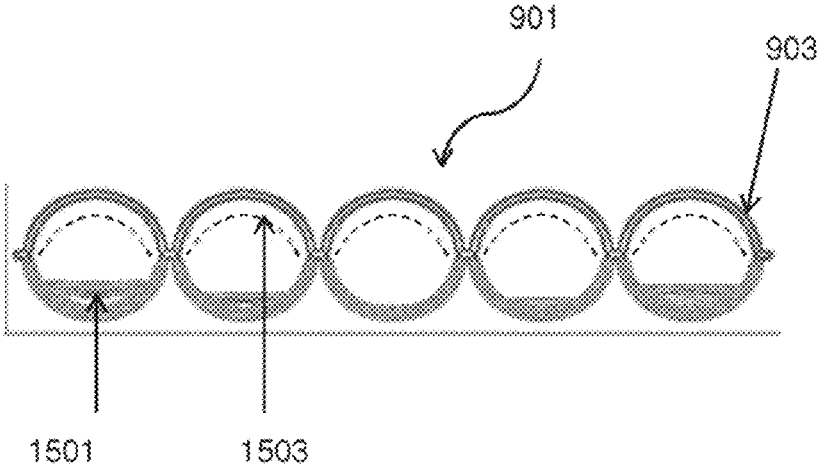
FIG. 17 illustrates a variation to the example of FIG. 9.

FIG. 16 is the cross-sectional plan view of the preferred configuration of the cushion 901, which comprises segmented gas-inflated tubes 903. FIG. 17 shows a variation of the cushion 901 of FIG. 16, wherein the gas-inflated tubes 903 are each partially filled with a liquid 1501. The liquid can be water or other commonly used liquid which is available at low cost without hazard concerns. Alternatively, the liquid is a viscous liquid or a mixture of volatile and viscous substances to increase the contact area of the liquid with the inner surfaces of the segmented gas-inflated tubes 903. More preferably, however, the liquid is a volatile one which is capable of absorbing sound energy by evaporation and releasing heat on condensation. Sound energy can also be dissipated by the viscous damping through hysteresis. FIG. 17 also shows droplets 1503 of volatile liquid adhering to the internal surface of the segmented gas-inflated tubes 903 further enhance sound absorption.

Figure 18:
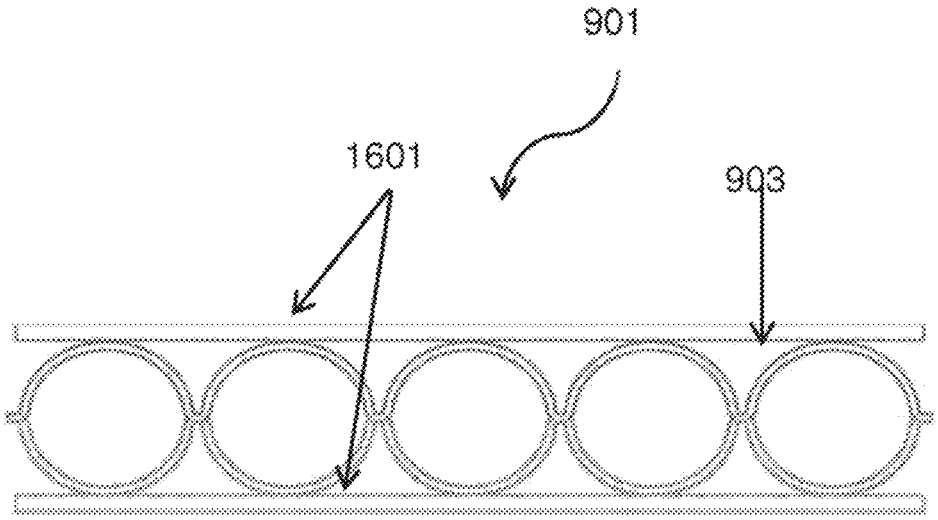
FIG. 18 illustrates a variation to the example of FIG. 9.

FIG. 18 is another plan view of the cushion 901 showing sound insulation or absorption layers 1601 covering or enveloping the main surface of the cushion 901. The sound insulation or absorption layers can be woven fabric material, plastic sheets, and corrugated cardboards and so on.

Figure 19:
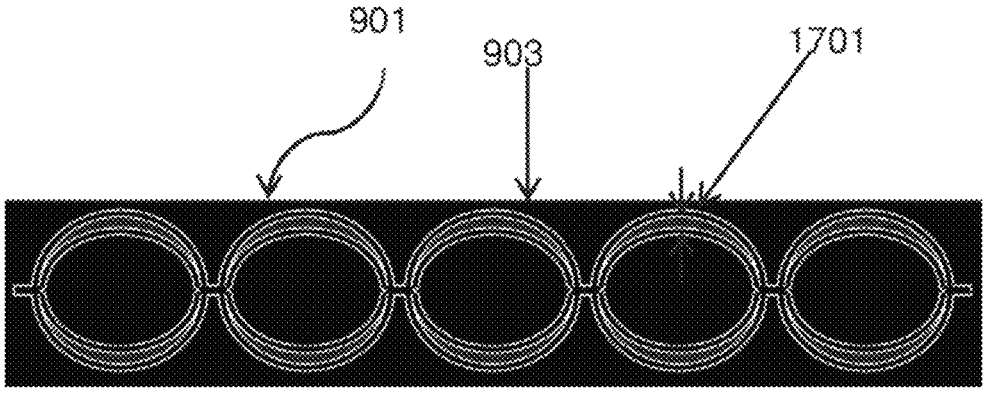
FIG. 19 illustrates a variation to the example of FIG. 9.

FIG. 19 is another plan view of the cushion 901 showing a constrained-layer damping design, which comprises gas-inflated tubes with double walls. Between the double walls 1701 of each gas-inflated tube is a viscous liquid or visco-elastic material. Vibration motion of the gas-inflated tubes forces a relative displacement of the liquid or visco-elastic material within the double walls 1701 to absorb sound energy; sound energy is effectively absorbed by the large contact area between the visco-elastic material and the internal walls of the double layer gas-inflated tubes.

The described noise barrier 100 possibly provide sound insulation performance similar to a conventional noise barrier, at up to Noise Isolation Class 30 and providing more than 35 dB(A) reduction of white noise.

Figure 20:
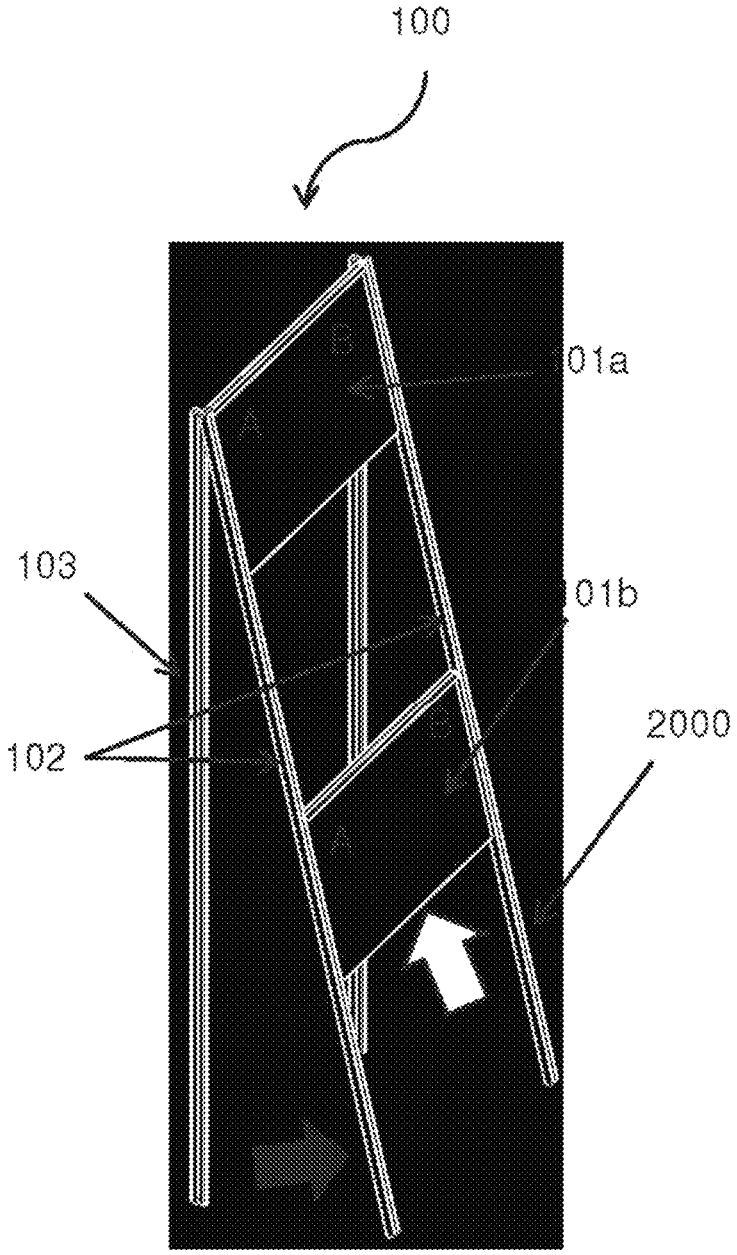
FIG. 20 illustrates a second embodiment of the invention.

FIG. 20 show a second embodiment which is a noise barrier 100. The noise barrier 100 has two main parts, namely, flexible noise barrier panels 101 and a frame 103 for mounting the noise barrier panels 101 thereon. The frame 103 provides standing support for noise barrier panels 101 and is made up of a pair of mounting poles 102 erected vertically on the ground.

The frame 103 is provided with a rail system 2000 for installation of noise barrier panels 101. The rail system 2000 is pivoted to the top of each mounting pole 102. Each rail 2000 is almost as long as the mounting pole 102. The black block arrow in FIG. 20 also illustrates how the lower end of the rail system 2000 can be pulled away from the leg of the mounting pole 102, so that the rail system 2000 is slanted at an angle to the frame 103.

Figure 21:
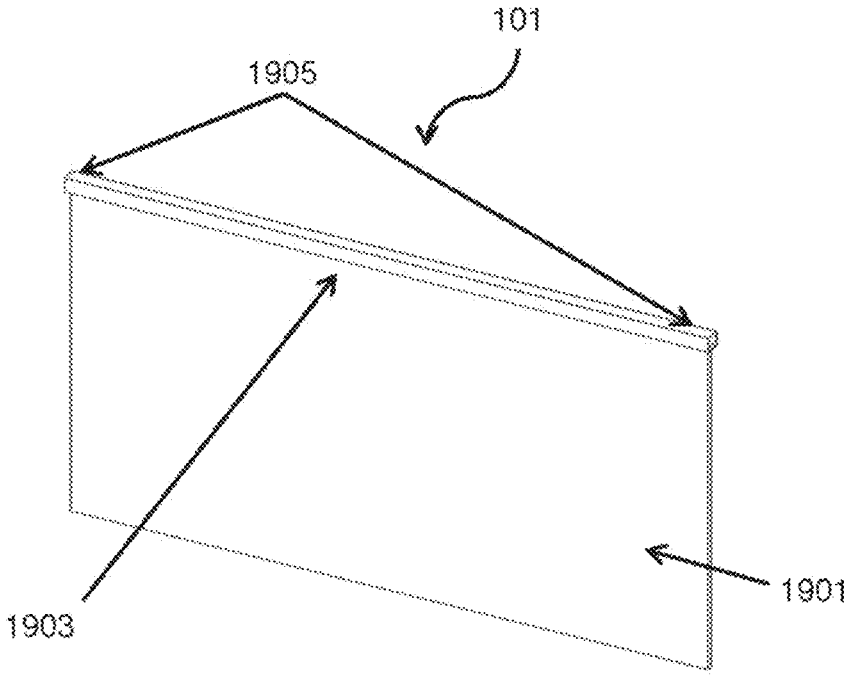
FIG. 21 illustrates a part of the second embodiment of FIG. 20.

FIG. 21 shows a noise barrier panel 101 for insertion into the rail system 2000. The noise barrier panel 101 provides a large surface area 1901 for insulating sound. The top side of the noise barrier panel 101 is attached to a mounting tube 1903. The mounting tube 1903 has two ends 1905, each of which extending over the respective lateral side of the noise barrier panel 101 for engaging the rail system 2000. The entire noise barrier panel 101 can be slid in the rail system 2000. The material used for the noise barrier panel 101 is either sound absorbing or sound blocking, and is light weight.

Between the ends of the mounting tube of a higher panel 101*a* and the corresponding ends of a mounting tube of a lower panel 101*b* are inserted dividers such as rods (not shown), i.e. between points A to A and between points B to B as labeled in FIG. 20. The dividers ensure that the top panel 101*a* is kept above the lower panel 101*b* at a pre-determined height. By pushing the lower panel 101*b* upwards, the ends 1905 of the mounting tube 1903 of the lower panel 101*b* push on the dividers, which in turn push on the ends 1905 of the mounting tube 1903 of the top panel 101*a*. This allows the panels to be installed at ground level and then slid up, as indicated by the white arrow in FIG. 20.

To provide an effective noise barrier wall, the bottom edge of a top noise barrier panel 101 preferably overlaps, or is aligned closely to the top edge of a bottom noise barrier panel 101.

Figure 22:
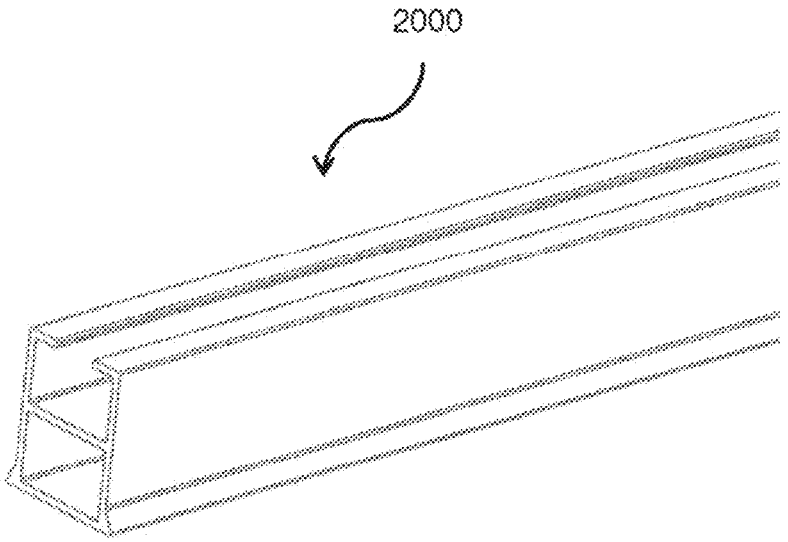
FIG. 22 illustrates a part of the second embodiment of FIG. 20.

FIG. 22 illustrates shows that the rail system 2000 comprises a U-shaped guide like a curtain rail.

Figure 23:
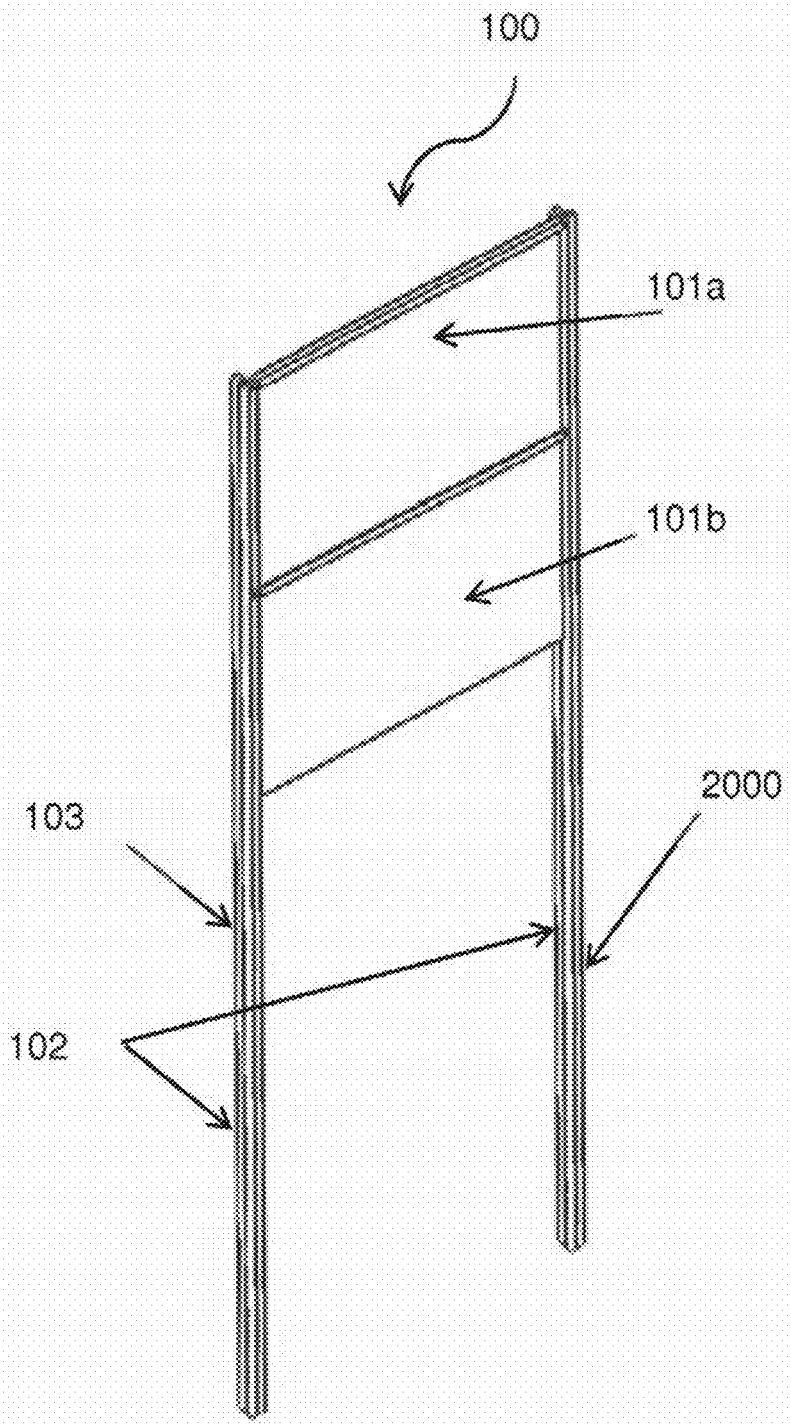
FIG. 23 further illustrates the second embodiment of FIG. 20.

FIG. 23 shows how the rails 2000 are pushed back to lie against the frame 103 after the noise barrier panels 101 have been inserted into the rails 2000. The structure as shown is a modular design, and two or more different independent frames 103 can be assembled side by side on site to extend a noise barrier 100 laterally.

When the wind load is high above the threshold, gaps between the overlapping panel edges are provided automatically by a shape-changing mechanism of the panels 101 to reduce the wind load. The shape-changing mechanism is provided by the material used for the body of the noise barrier panel 101. The material can be any which is flexible and bend-able to allow wind passage, and resilient enough to revert to the original position under normal wind condition. It is preferred that the body of the noise barrier panel 101 comprises a cushion 901 made of segmented gas inflated tubes 903, such as the one discussed in FIG. 9. Normally, the gas-inflated tubes are stiff enough in their axial direction to provide an upstanding panel with minimal support. When the wind becomes strong enough, the segmented gas inflated tubes 903 can be deformed by the wind; the gas-inflated tubes can be folded or collapsed by the wind.

Since wind load on the noise barrier 100 is limited by a shape-changing mechanism, noise barrier 100 does not need to be made of heavy material or a concrete foundation, and can be made of light material which is easy for manual installation.

Figure 24:
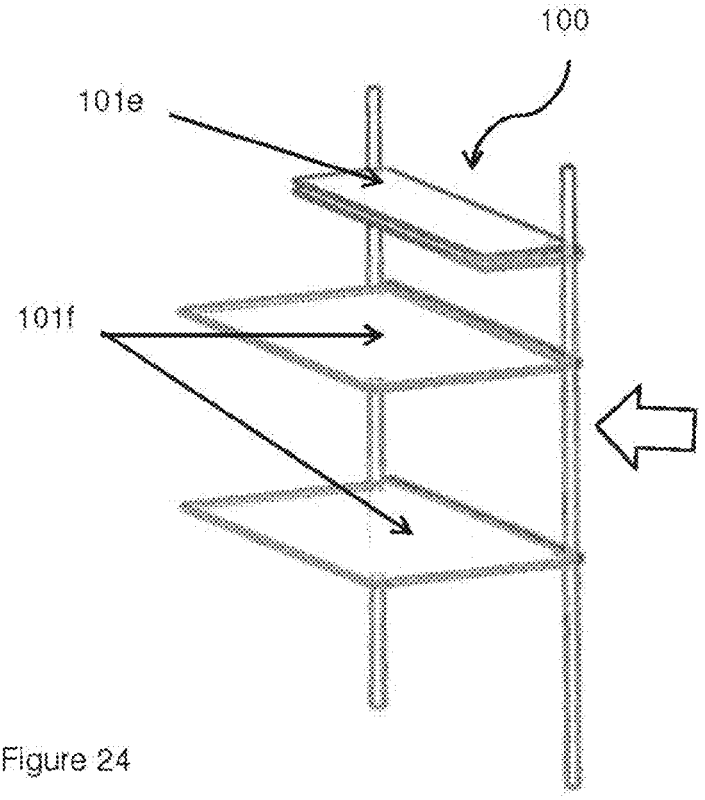
FIG. 24 illustrates the second embodiment of FIG. 20 in opened position.

FIG. 24 shows a variation of the embodiment, which is a frame 103 installed with three noise barrier panels 101. The top noise barrier panel 101*e* has a different design to that of the two lower noise barrier panels 101*f*. The mounting tube 1903 of each of the two lower noise barrier panels 101*f* is placed at the top side of the respective noise barrier panel 101*f*, that is, the noise barrier panel 101*f* hangs down from the mounting tube 1903. In contrast, the mounting tube 1903 of the top noise barrier panel 101*e* is placed across the middle of the noise barrier panel 101*e*, and all four sides of the noise barrier panel 101*e* are not affixed to any mounting tube 1903. The noise barrier panels 101 are illustrated as flapping open in the presence of wind. The wind direction is indicated by the block arrow. In the open position, wind load on the noise barrier 100 is reduced significantly due to reduction of cross-sectional area orthogonal to the wind direction. The top noise barrier panel 101*e* folds around the mounting tube 1903 to bend; both the top and the bottom edges of the top noise barrier panel 101*e* are moved according to the direction of the wind. The lower two noise barrier panels 101*f* simply fold and swivel about the mounting tube 1903 at their top edges.

When the wind dies down, the resilience in the noise barrier panel 101 material returns the noise barrier panel 101 into its original configuration automatically, to resume function as noise barrier.

Therefore, wind load on the noise barrier 100 is limited by the wind load threshold at which the noise barrier panels 101 open. It is estimated that the wind load on the fully open noise barrier is only one-tenth of the barrier without opening, at between 0.02 to 0.3 kPa, which is only 2% to 25% of the conventional outdoor noise barrier loading requirement of about 1.2 kPa. This makes it possible to construct the embodiment with light material. The light material provides that the noise barrier is so easy to erect and dismantle, without using cranes or elevated platforms, that it is suitable for temporal, short period use.

The noise barrier panels of this embodiment is small and lightweight with a preferable size of less than 5 m2 and surface density less than 2 kg/m2.

In a variation of the embodiment, the edges of a noise barrier panel 101 are provided with magnetic material to act as magnetic locks. The magnetic material in the lateral edges of the noise barrier panel 101 is attracted to corresponding magnetic material in the vertical mounting poles 102. In this case, determining the threshold wind load has to take into account the strength of the magnetic attraction between the free edges of the noise barrier panel 101 and the mounting poles 102.

Figure 25:
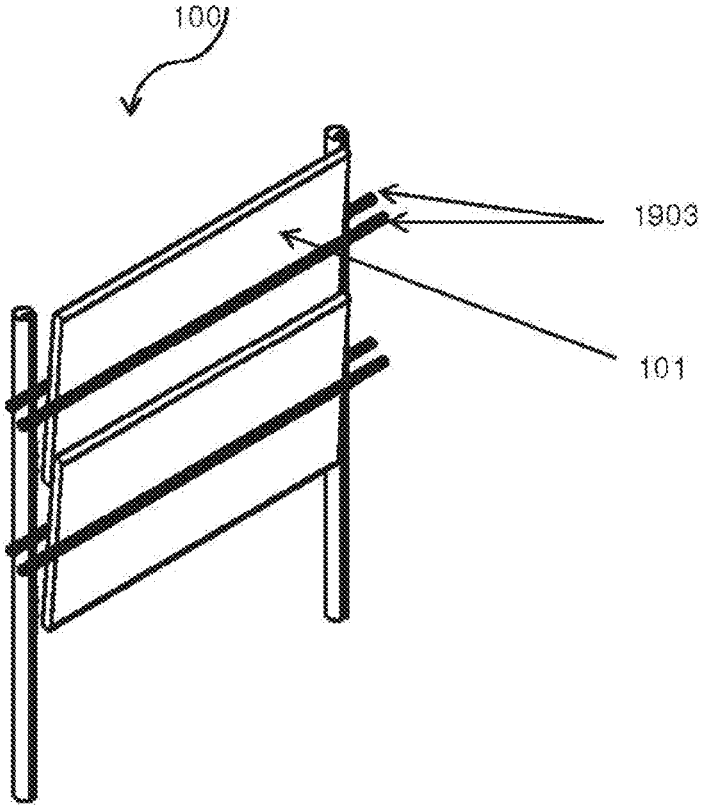
FIG. 25 illustrates a variation of the second embodiment of FIG. 20.
Figure 26:
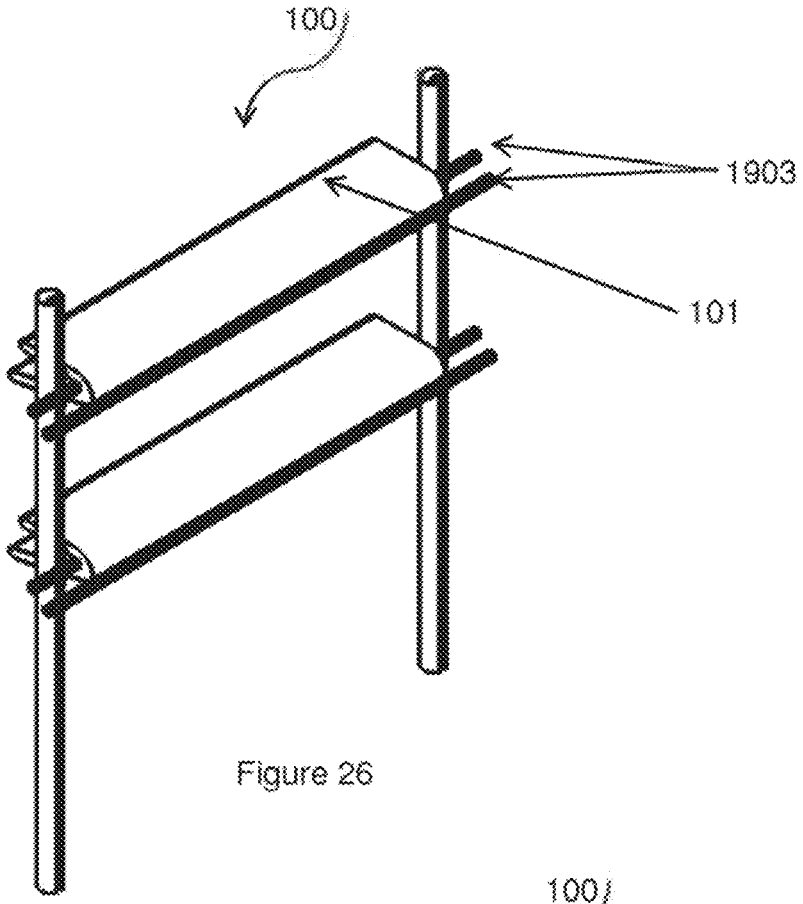
FIG. 26 illustrates the embodiment of FIG. 25 in opened position.

FIG. 25 and FIG. 26 shows a variation of the embodiment, wherein all the noise barrier panels 101 are each sandwiched between two mid-section mounting tubes 1903, so that wind may blow in any direction and the panel 101 can bend according to that the wind direction on either side of the noise barrier 100.

The described noise barrier panels 101 do not require a pivoting mechanism to flap open in the wind, as they are capable of deforming in wind. However, if the noise barrier panel 101 is made of a rigid and unbendable material, the noise barrier panel 101 is secured to the frame by a pivoting mechanism. For example, the mounting tubes 1905 can be mounted on the railing to be able to turn pivotally.

Figure 27:
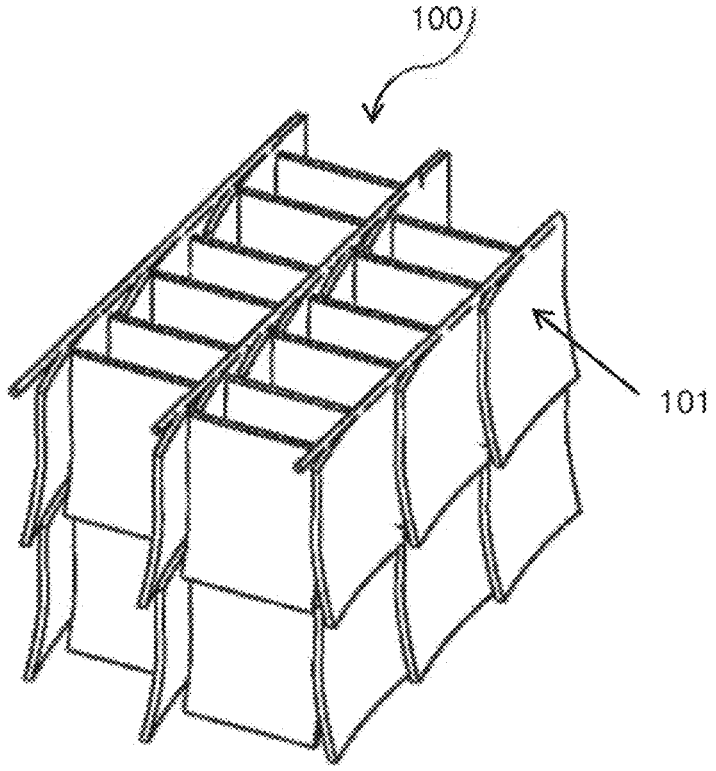
FIG. 27 illustrates a third embodiment of the invention.

FIG. 27 shows a further embodiment, which is noise barrier 100 comprising an array of noise barrier panels 101. The noise barrier panels 101 are made of hanging fabric such as woven curtain, or flexible plastic sheets. The noise barrier panels 101 are arranged to form several parallel noise barrier walls facing a construction site. These are crossed orthogonally by yet several other noise barrier walls facing the side. When there is wind, the panels are blown apart to opens up a wind passage. The higher the number of parallel noise barrier walls, the higher the wind load threshold. The panels facing sideway help to prevent small displacements of the panels facing the front during very mild wind condition, to maintain noise barrier function.

Figure 28:
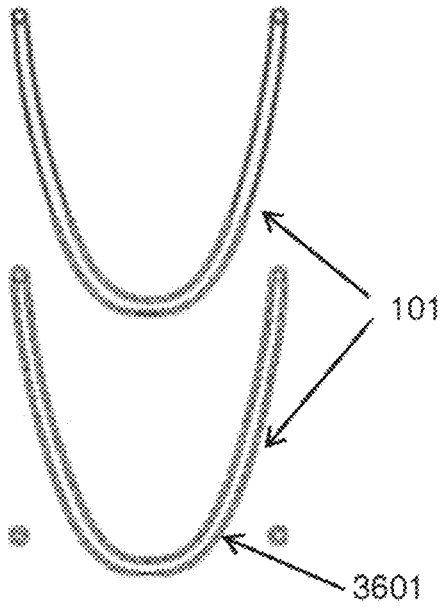
FIG. 28 illustrates a fourth embodiment of the invention.

FIG. 28 shows another embodiment in which the noise barrier panel 101 can be a piece of flexible material, the ends of which are hanging from two horizontal supports to form a sort of U-shaped or V-shaped hanging curtain 101 having a bottom apex 3601. The bottom apex 3601 of the hanging curtain 101 can be inserted slightly between the two opposite ends of a similar hanging curtain immediately below. The overlap of the lower apex 3601 of an upper curtain and the two ends of a lower curtain forms a vertically continual wall for blocking noise.

Figure 29:
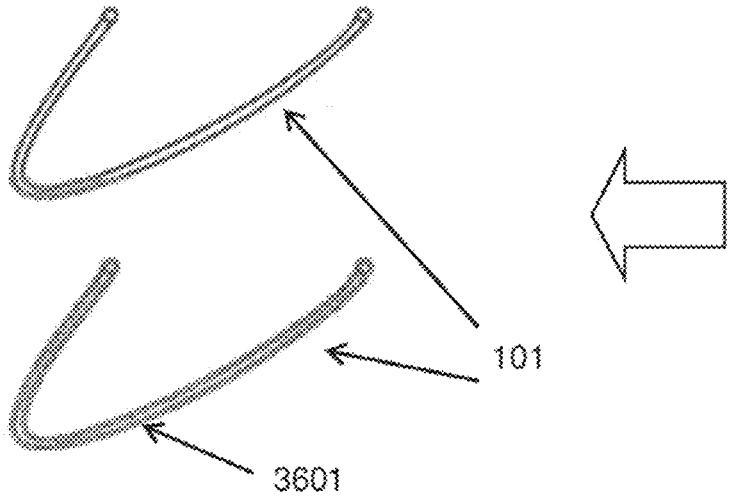
FIG. 29 is another view of the embodiment of FIG. 28.

FIG. 29 shows how the loose hanging curtain can be blown by wind in the direction of the block arrow to allow wind passage. In this case, the threshold for opening the curtains depends on the weight of the material used for the curtains. The heavier the weight, the stronger the wind to blow a curtain aside. The apex 3601 can be provided with holes to prevent collection of rain water.

Where the embodiments of FIG. 27 to FIG. 29 uses fabric or flexible material for the body of the noise barrier panel 101, the noise barrier panel 101 cannot be used to be pushed up one another from the bottom of the frame 103.

In practice, three grades of noise barriers can be provided depending on site condition:

Grade 1 noise barrier has a lightweight structure which is designed for daily installation and removal. Flexible noise barrier panels are designed to be detached from the frame structure under extreme wind to minimize wind load. The maximum loading of the structure is designed to be in the range of 5 to 20 kg/m2 of the noise barrier.

Grade 2 noise barrier has a slightly stronger structure than Grade 1 which is designed for temporary use for several months. Daily installation and removal is not required but removal before typhoon may be necessary. The maximum loading of the structure is designed to be in the range of 10 to 50 kg/m2 of the noise barrier.

Grade 3 noise barrier is designed as a permanent structure which can withstand the worst wind load condition with sufficient safety factor. It has the strongest structure among the three types of noise barrier but the structure requirement is still less than the conventional barrier of the same height, due to wind load reducing mechanisms as described. The maximum loading of the structure is designed to be in the range of 50 to 100 kg/m2 of the noise barrier.

Accordingly, a noise barrier 100 has been described comprising at least one noise barrier panel 101 which is capable of being moved by the force of wind to allow passage of wind.

In a preferred embodiment, the noise barrier 100 comprises at least one noise barrier panel 101, the at least one noise barrier panel 101 having a close position for providing barrier to noise, the at least one noise barrier panel 101 having an open position to allow passage of wind, wherein the at least one noise barrier panel 101 is capable of being moved by the force of wind from the closed to the open position. Embodiments have been described wherein the noise barrier panel 101 opens by turning or folding relative to a vertical axis or a horizontal axis.

A noise barrier 100 has also been described comprising at least one mounting pole, 102 at least one noise barrier panel 101 mounted on the at least one mounting pole 102 to be slide-able on the mounting pole 102.

The noise barrier 100 can be set up by an operating company, or if the user prefers, the user can order a noise barrier kit, comprising at least one mounting pole, at least one noise barrier panel suitable for mounting onto the at least one mounting pole to be slide-able along the mounting pole. The user can set up the noise barrier himself at any time convenient for him without requiring any heavy machinery.

While there has been described in the foregoing description preferred embodiments of the present invention, it will be understood by those skilled in the technology concerned that many variations or modifications in details of design, construction or operation may be made without departing from the scope of the present invention as claimed.

For example, even though a X-shape cross bar is described in FIG. 5, it is possible that other methods of joining two or three adjacent mounting poles 102 into one standing unit of noise barrier is possible, as the skilled man would know.

For example, the mounting pole 102 is foldable or retractable.

The invention claimed is:

1. A noise barrier comprising:

at least one noise barrier panel which is adapted for being moved by a wind force to allow passage of wind thereby wherein:

the at least one noise barrier panel has a closed position for providing a barrier to noise;

the at least one noise barrier panel has an open position to allow passage of wind;

the at least one noise barrier panel is capable of being moved by the force of wind from the closed position to the open position; and the at least one noise barrier panel is foldable for being moved from the closed position to the open position.

2. A noise barrier as claimed in claim 1, further comprising at least one mounting pole, wherein the at least one noise barrier panel comprises a plurality of noise barrier panels, each panel of the plurality of noise barrier panels adapted for upwardly slidable mounting on the mounting pole.

3. A noise barrier as claimed in claim 1, wherein the at least one noise barrier panel has a a sleeve at a lateral side for slipping over a pole wherein the panel is foldable from the closed position to the open position in turning about an axis of the pole.

4. A noise barrier as claimed in claim 3, wherein the sleeve is openable and closable by a zipper that runs along a full length of the sleeve.

5. A noise barrier as claimed in claim 3, wherein the at least one noise barrier panel is enveloped in a fabric material that is sewn into the sleeve at the lateral side of the panel.

6. A noise barrier as claimed in claim 1, wherein the at least one noise barrier panel has a magnetic material for keeping the at least one noise barrier panel in the closed position.

7. A noise barrier as claimed in claim 6, wherein the at least one noise barrier panel has a first side having a first magnetic material;

the at least one noise barrier panel has a second side having a second magnetic material;

the second magnetic material of the second side of the at least one noise barrier panel being capable of magnetically cooperating with a first magnetic material of a first side of an adjacent noise barrier panel.

8. A noise barrier as claimed in claim 1, wherein the at least one noise barrier panel comprises an inflatable cushion.

9. A noise barrier as claimed in claim 8, wherein the inflatable cushion contains a plurality of inflatable segments.

10. A noise barrier panel as claimed in claim 9 wherein one or more of the inflatable segments contains a sound absorbing liquid.

11. A noise barrier as claimed in claim 8, wherein the inflatable cushion contains a liquid capable of absorbing sound energy.

12. A noise barrier as claimed in claim 1, further comprising at least one mounting pole;

the at least one noise barrier panel being adapted for slidably mounting on the mounting pole so as to be upwardly slide-able along the mounting pole.

13. A noise barrier comprising at least one mounting pole;

at least one noise barrier panel mounted on the at least one mounting pole to be slide-able upwardly along the mounting pole.

14. A noise barrier kit, comprising at least one mounting pole;

at least one noise barrier panel adapted for mounting onto the at least one mounting pole so as to be slide-able upwardly along the mounting pole.

15. A noise barrier panel comprising an inflatable body suitable for mounting onto a mounting pole, such that the mounted noise barrier panel is capable of being moved by the force of wind to allow passage of wind; wherein the at least one noise barrier panel has a closed position for providing barrier to noise;

the at least one noise barrier panel has an open position to allow passage of wind; wherein the at least one noise barrier panel is capable of being moved by the force of wind from the closed position to the open position; and the noise barrier panel is capable of folding to move from the closed position to the open position.

16. A noise barrier panel as claimed in claim 15, wherein the inflatable body comprises a plurality of inflatable segments.

17. A noise barrier panel as claimed in claim 15, further comprising a sleeve for mounting the at least one noise barrier panel onto the mounting pole.

18. A noise barrier panel as claimed in claim 15, wherein the at least one noise barrier panel comprises a first side having a first magnetic material;

a second side having a second magnetic material;

the second magnetic material of the second side of the at least one noise barrier panel being capable of magnetically cooperating with a first magnetic material of a first side of an adjacent noise barrier panel.

19. A method of installing a noise barrier comprising the steps of:

providing at least one mounting pole;

providing a first noise barrier panel;

mounting the first noise barrier panel onto the at least one mounting pole;

sliding the first noise barrier panel upwardly along the at least one mounting pole.

20. A method of installing a noise barrier as claimed in claim 19, comprising the further step of:

providing a second noise barrier panel;

mounting the second noise barrier panel onto the at least one mounting pole;

sliding the second noise barrier panel on the at least one mounting pole to push the first noise barrier panel upwardly along the at least one mounting pole.

* * * * *